US005626235A

United States Patent [19]

Aikawa

[11] Patent Number: 5,626,235

[45] Date of Patent: May 6, 1997

[54] PAPERMAKING SCREEN

[75] Inventor: Yoshihiko Aikawa, Shizuoka, Japan

[73] Assignee: Aikawa Iron Works Co., Ltd., Shizuoka-ken, Japan

[21] Appl. No.: 552,083

[22] Filed: Nov. 2, 1995

[30] Foreign Application Priority Data

Sep. 21, 1995 [JP] Japan ..... 7-242651

[51] Int. Cl.[6] ..... B07B 1/49

[52] U.S. Cl. ..... 209/395; 209/407

[58] Field of Search ..... 209/664, 393, 209/395, 404, 405, 406, 407, 410, 411, 412

[56] References Cited

U.S. PATENT DOCUMENTS

| | | | |
|---|---|---|---|
| 658,288 | 9/1900 | Shaw et al. | 209/393 X |
| 806,383 | 12/1905 | Williams | 209/395 |
| 824,720 | 7/1906 | Hunnicutt | 209/393 X |
| 944,780 | 12/1909 | Frickey | 209/395 X |
| 1,043,196 | 11/1912 | Bowers | 209/395 |
| 1,085,638 | 2/1914 | Shelton | 209/393 X |
| 1,414,132 | 4/1922 | Hurrell | 209/393 X |
| 1,770,977 | 7/1930 | Fowden | 209/395 X |
| 1,782,953 | 11/1930 | Andreas | 209/395 |
| 2,850,165 | 9/1958 | Hesse et al. | 209/395 X |
| 4,130,479 | 12/1978 | Schiele | 209/393 |
| 4,828,689 | 5/1989 | Lamort | 209/393 |

*Primary Examiner*—D. Glenn Dayoan
*Attorney, Agent, or Firm*—Kanesaka & Takeuchi

[57] ABSTRACT

A papermaking screen of the invention is formed of a first annular supporting member having a first annular recess formed at one side, and a second annular supporting member having a second annular recess at one side. The second annular recess has a size corresponding to that of the first annular recess and orients toward the first annular recess. A plurality of space holding members is fixed to the first and second annular supporting members to establish a predetermined distance therebetween. Also, a plurality of elongated members is situated in the first and second annular recesses and arranged parallel to each other between the first and second annular supporting members. At least one of two elongated members situated adjacent to each other has a space forming device thereon relative to the other of the two elongated members. When the elongated members are arranged parallel to and contacted to each other, a space is formed between the elongated members situated adjacent to each other. The elongated members can be easily disposed between the first and second annular supporting members.

12 Claims, 23 Drawing Sheets

PAPERMAKING SCREEN

BACKGROUND OF THE INVENTION AND RELATED ART STATEMENT

The present invention relates to a papermaking screen, more particularly, a papermaking screen capable of using as slits spaces formed by arranging longitudinally extending members in parallel.

The present applicant has filed Japanese Patent Application No. 6-328815, wherein a papermaking screen uses as slits spaces formed by arranging longitudinally extending members in parallel.

The papermaking screen is formed of a first annular supporting member provided at one end, a second annular supporting member provided at the other end thereof, and longitudinally extending members. One end of the longitudinally extending member is fixed to the first annular supporting member, and the other end of the longitudinally extending member is fixed to the second annular supporting member. The longitudinally extending members are disposed parallel in an annular shape to thereby form a space, as a slit, between the respective parallel members.

However, in the prior art papermaking screen, both ends of the longitudinally extending members disposed in parallel have to be fixed by welding, respectively. Further, since the longitudinally extending members are large in number, there has been a problem of poor productivity.

The present invention is to provide a papermaking screen to solve the above defects.

SUMMARY OF THE INVENTION

In accordance with the invention, a papermaking screen includes a first annular supporting member having a first annular recess formed at one side, a second annular supporting member having a second annular recess at one side, and a plurality of space holding members fixed to the first and second annular supporting members to establish a predetermined distance therebetween. The second annular recess has a size corresponding to that of the first annular recess and orients toward the first annular recess.

In the invention, a plurality of elongated members is situated in the first and second annular recesses to be arranged parallel to each other between the first and second annular supporting members. At least one of two elongated members situated adjacent to each other has space forming means thereon relative to the other of the two elongated members. Therefore, when the elongated members are arranged parallel to and contacted to each other, a space is formed between the elongated members situated adjacent to each other.

In the invention, the elongated members are simply situated in the first and second annular recesses to be contacted to each other. Nevertheless, the space is formed between the adjacent two elongated members. Each elongated member need not be fixed to the first and second annular supporting members. Therefore, the assembly of the papermaking screen of the invention can be made easily.

The space forming means is formed of at least one projection integrally formed with the elongated member. The projection contacts the elongated member situated adjacent thereto to thereby form the space between the elongated members. Preferably, the elongated member has two annular projections at longitudinal ends thereof. A portion between the annular projections forms the space.

The elongated members may be divided into first and second groups. Each elongated member in the first group may have two projections at the longitudinal ends, and each elongated member in the second group may have no projection. In this case, the elongated members in the first and second groups are alternately arranged, respectively.

On the other hand, each elongated member in the first group may have two projections at the longitudinal ends, and each elongated member in the second group may have one projection in a middle thereof. The elongated members in the first and second groups are alternately arranged, as well.

The elongated member has a circular shape in a lateral cross section at a portion other than the projection. However, the elongated member may have a semicircular shape with a curved portion and a flat portion in a lateral cross section at a portion other than the projection. In this case, the elongated members are arranged such that the curved portion in each of the elongated members faces the flat portion of each of the elongated members situated adjacent thereto.

In the invention, further, the elongated members may be divided into first and second groups. Each elongated member in the first group has a circular shape in a lateral cross section at a portion other than the annular projection, and each elongated member in the second group has a shape other than circular in a lateral cross section at a portion other than the annular projection. In this case, the elongated members in the first and second groups are alternately arranged, respectively. The shape other than circular in the second group is preferably a polygonal shape.

In the papermaking screen of the invention, the plurality of elongated members arranged annularly may be cut perpendicularly to longitudinal directions of the elongated members to divide the elongated members into at least two annular groups arranged side by side in the longitudinal directions. In this case, an intermediate supporting member with annular recesses on both sides is disposed between the two annular groups.

In particular, each of the divided elongated members near the first annular supporting member is located in the first annular recess at one end and in the annular recess of the intermediate supporting member at the other end thereof. Also, each of the divided elongated members near the second annular supporting member is located in the second annular recess at one end and in the annular recess of the intermediate supporting member at the other end thereof. The divided elongated members in each annular group are arranged parallel to each other with a space between the two divided elongated members. Namely, at least one of two divided elongated members situated adjacent to each other in each annular group has space forming means thereon relative to the other of the two divided elongated members. Therefore, when the divided elongated members are arranged parallel to and contacted to each other, the space is formed between the divided elongated members situated adjacent to each other.

The plurality of elongated members situated between the first and second annular supporting members may be divided into more than two in the longitudinal directions to form more than three annular groups. One intermediate supporting member is situated between the annular groups adjacent to each other. Also, each group has the same structure as explained above.

In case the elongated members are divided, the divided elongated members can be made short. Thus, the space between the divided elongated members do not substantially change, and the rigidity of the screen is assured.

DETAILED DESCRIPTION OF PREFERRED EMBODIMENTS

Figure 1:
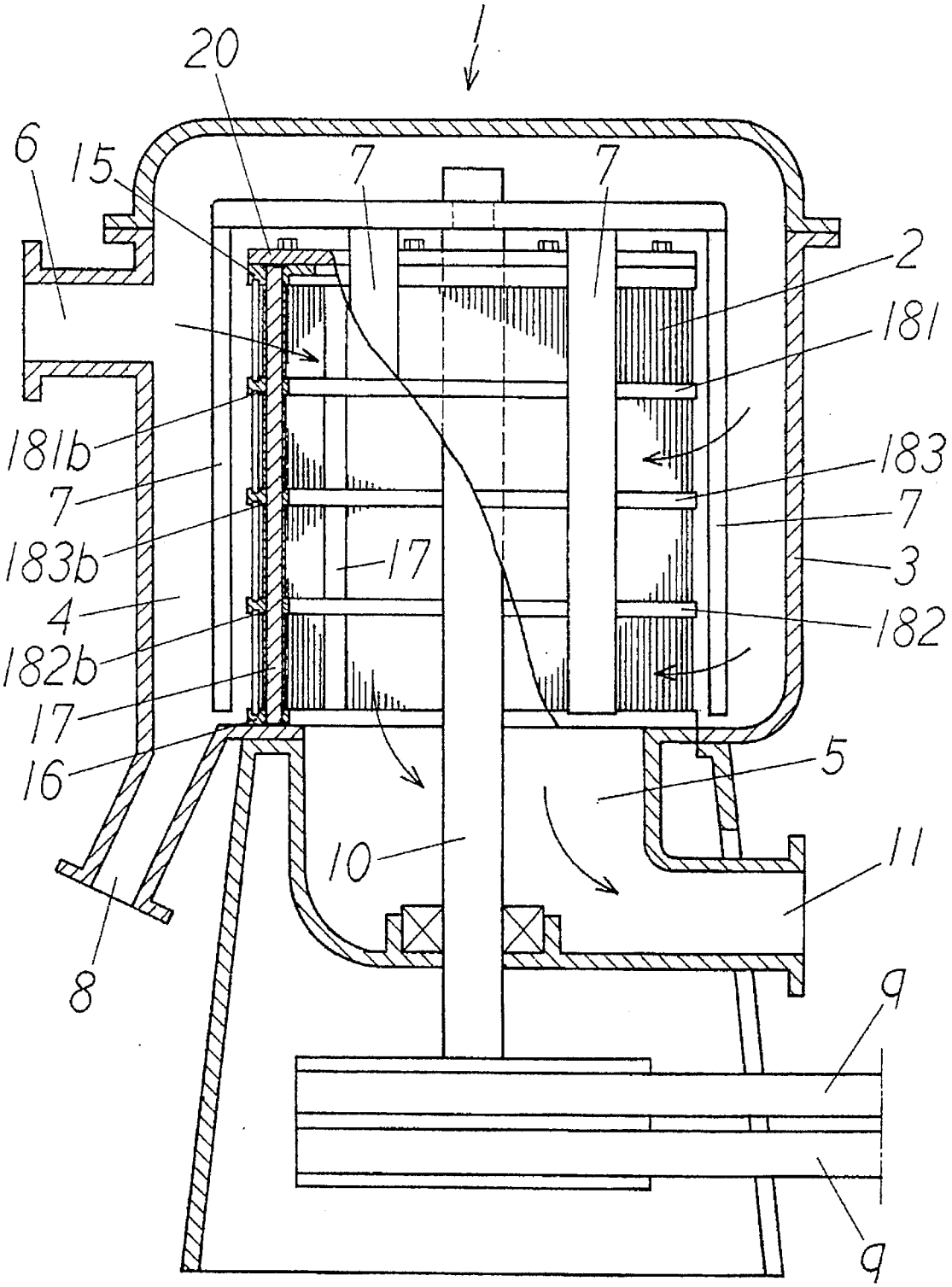
FIG. 1 is a schematic section view of a papermaking screen apparatus incorporating a papermaking screen of an embodiment according to the present invention.

Hereinbelow, referring to the drawings, a papermaking screen of an embodiment according to the present invention is described.

In FIGS. 1 to 30, reference numeral 1 represents a papermaking screen device. The papermaking screen device 1 is a type, wherein a papermaking material flows into an inner portion of a papermaking screen 2 from an outside thereof to thereby clean the papermaking material, and a casing 3 is approximately divided into a primary chamber 4 and a secondary chamber 5 in its interior by the papermaking screen 2, as shown in FIG. 1.

The primary chamber 4 is provided with an inlet 6 for feeding a papermaking material, such as pulp and old paper, into the casing 3, agitating members 7 for agitating the papermaking material, and a foreign material discharging port 8. The foreign material discharging port 8 is opened and closed by, for example, a valve (not shown).

The agitating members 7 are rotated by an axis 10 driven by rotation transmitted from a motor (not shown) through belts 9.

Reference numeral 11 is an exit for discharging the cleaned papermaking material outside the casing 3, and the papermaking material exit 11 is provided to the secondary chamber 5.

Figure 2:
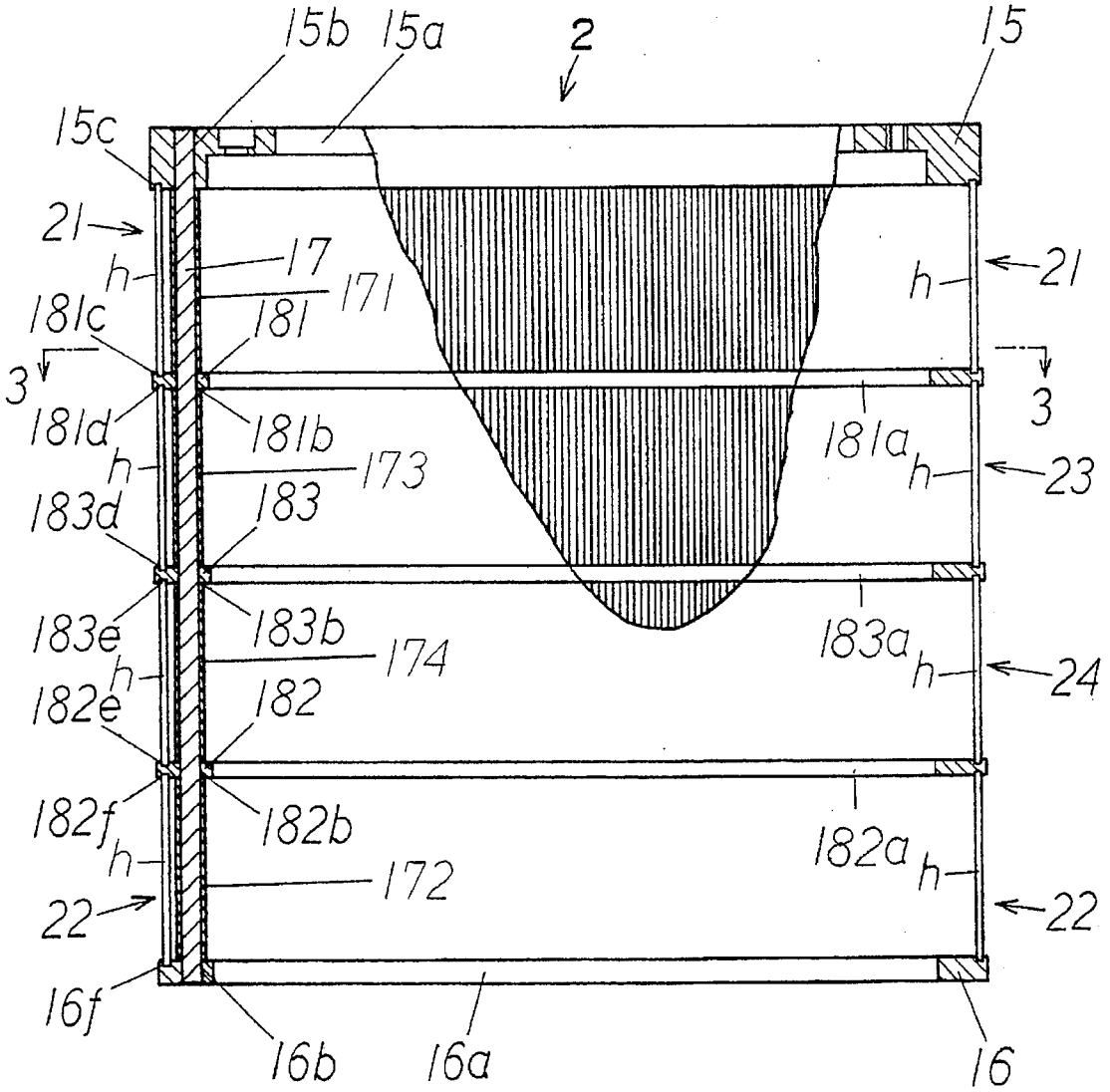
FIG. 2 is a schematic vertical section view of the papermaking screen shown in FIG. 1.

The papermaking screen 2, as shown in FIG. 2, is provided with a first annular supporting member 15 at one end, and a second annular supporting member 16 at the other end thereof, respectively.

Figure 6:
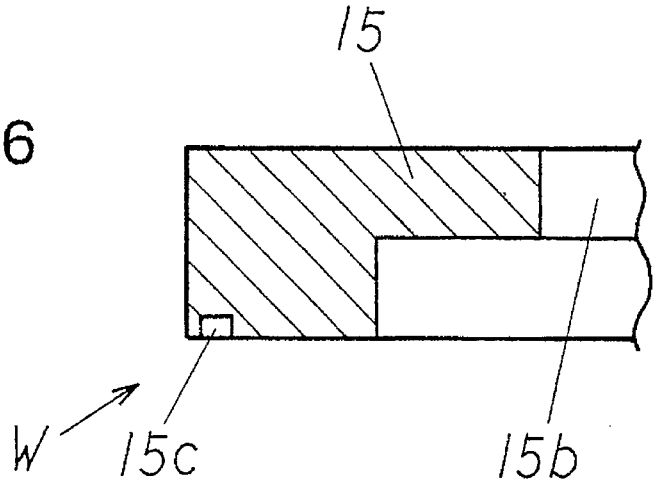
FIG. 6 is a schematic section view of a first supporting member.
Figure 7:
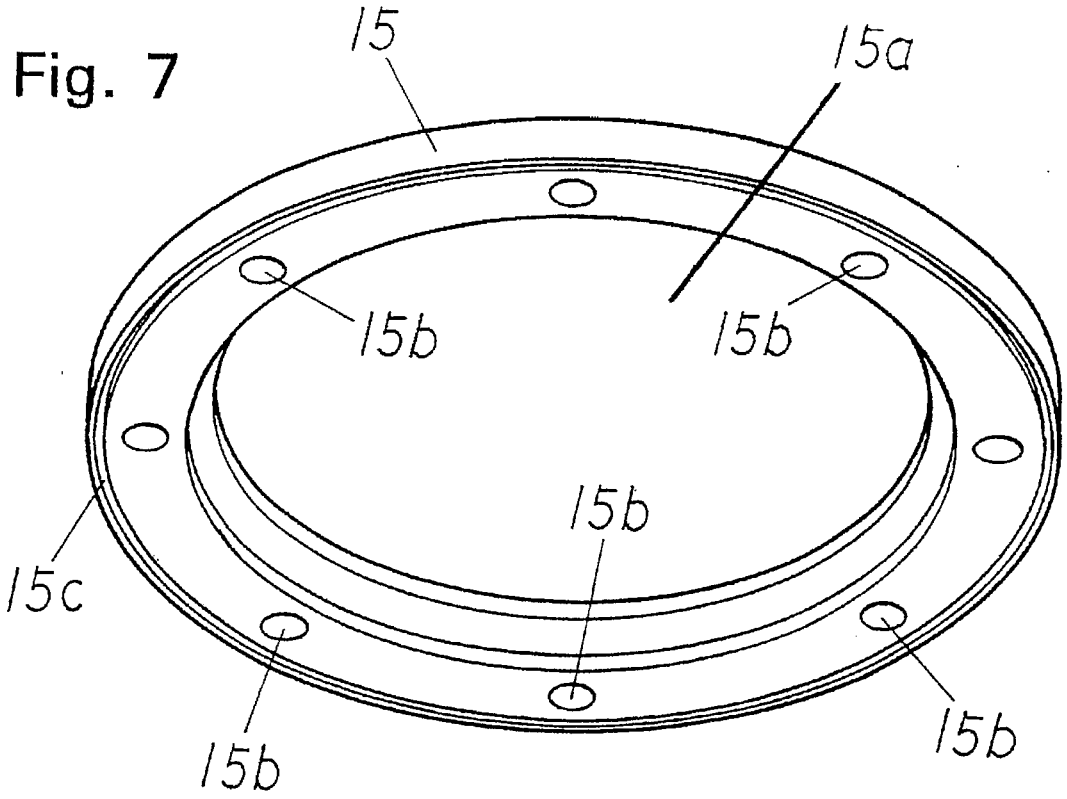
FIG. 7 is a schematic perspective view of the first supporting member viewed from a direction of an arrow W in FIG. 6.

The first supporting member 15 is provided with an opening 15*a*, and the opening 15*a* is closed by a ceiling plate 20 as shown in FIG. 1. Incidentally, the first supporting member 15 may not be provided with the opening 15*a* and the ceiling plate 20 may be omitted (not shown). Also, the first supporting member 15 is provided with insertion ports 15*b* for inserting space holding members 17, which will be described later, as shown in FIGS. 6 and 7.

Figure 8:
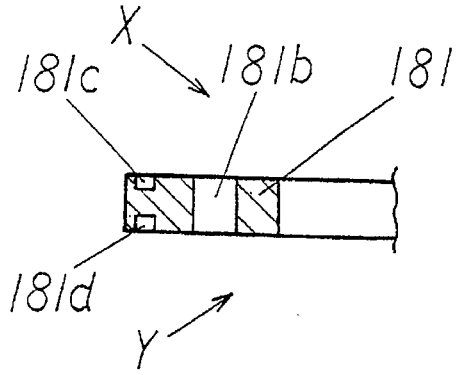
FIG. 8 is a schematic section view of an intermediate supporting member.
Figure 9:
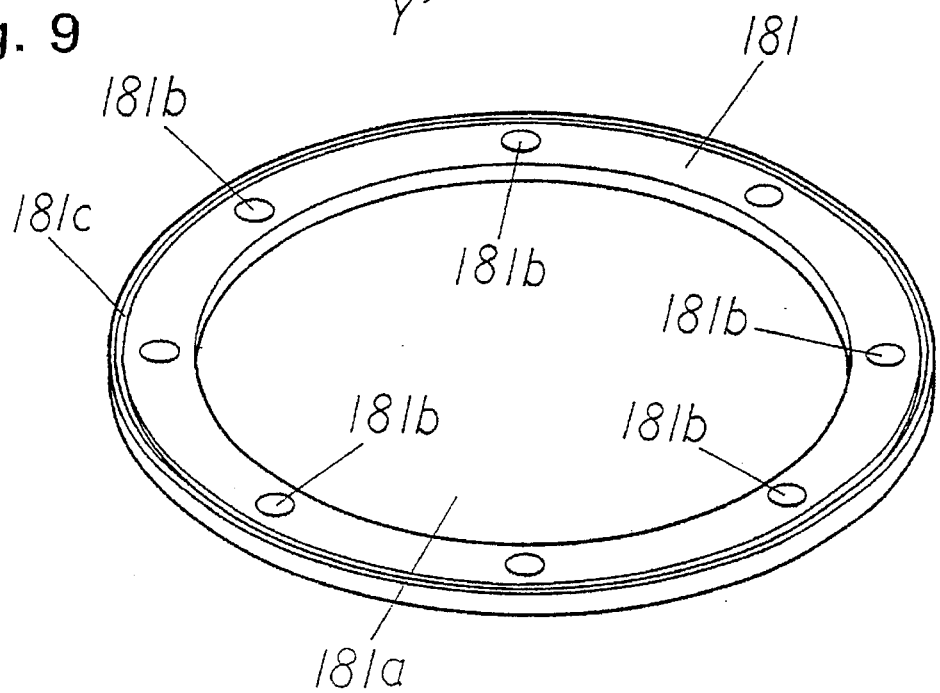
FIG. 9 is a schematic perspective view of the intermediate supporting member viewed from a direction of an arrow X in FIG. 8.
Figure 10:
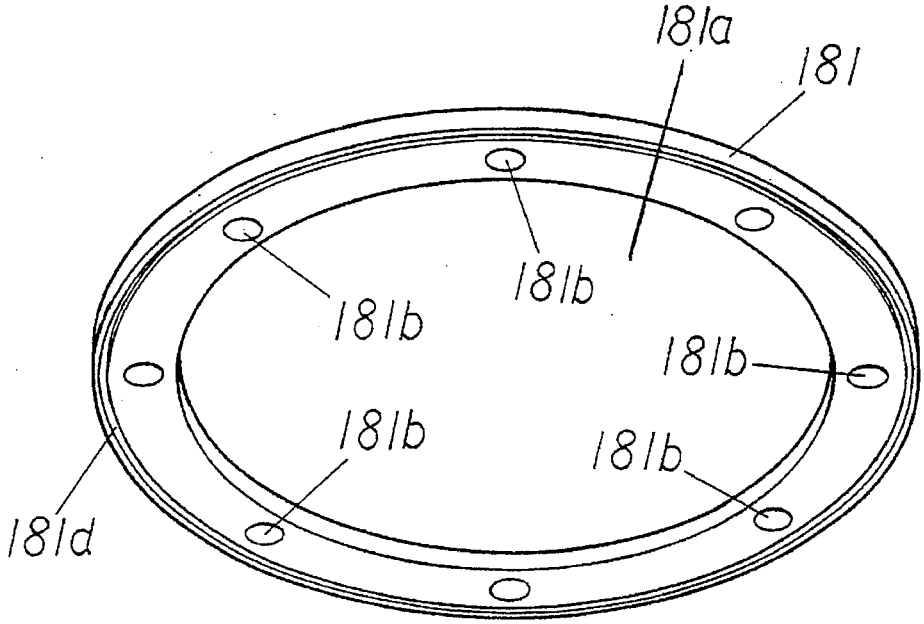
FIG. 10 is a schematic perspective view of the intermediate supporting member viewed from a direction of an arrow Y in FIG. 8.

Also, the first supporting member 15 is provided with an annular recess 15*c*, and an intermediate supporting member 181, which will be described later, adjacent to the first supporting member 15 is provided with an annular recess 181*c* as shown in FIGS. 2, 8 and 9. The recesses 15*c* and 181*c* are provided on facing sides of the first supporting member 15 and the intermediate supporting member 181 adjacent thereto, respectively.

Figure 11:
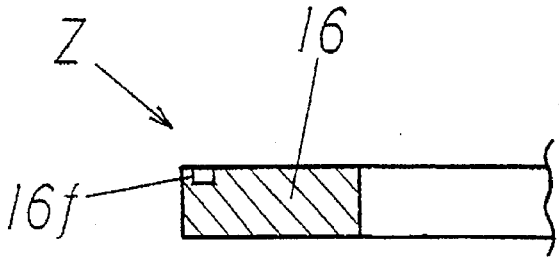
FIG. 11 is a schematic section view of a second supporting member.
Figure 12:
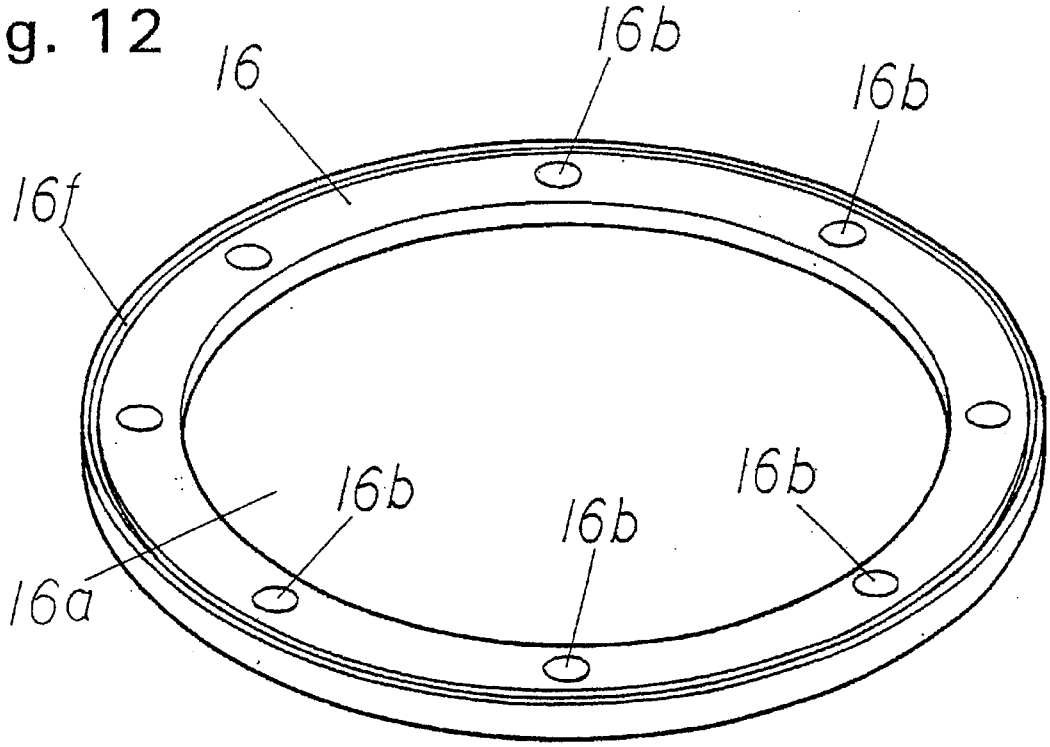
FIG. 12 is a schematic perspective view of the second supporting member viewed from a direction of an arrow Z in FIG. 11.

Also, the second supporting member 16 is provided with an opening 16*a* for passing the cleaned papermaking material therethrough. The second supporting member 16 is provided with an annular recess 16*f* as shown in FIGS. 2, 11 and 12, and an intermediate supporting member 182, which will be described later, adjacent to the second supporting member 16 is provided with an annular recess 182*f*. The recesses 16*f* and 182*f* are provided on facing sides of the second supporting member 16 and the intermediate supporting member 182 adjacent thereto, respectively.

Figure 3:
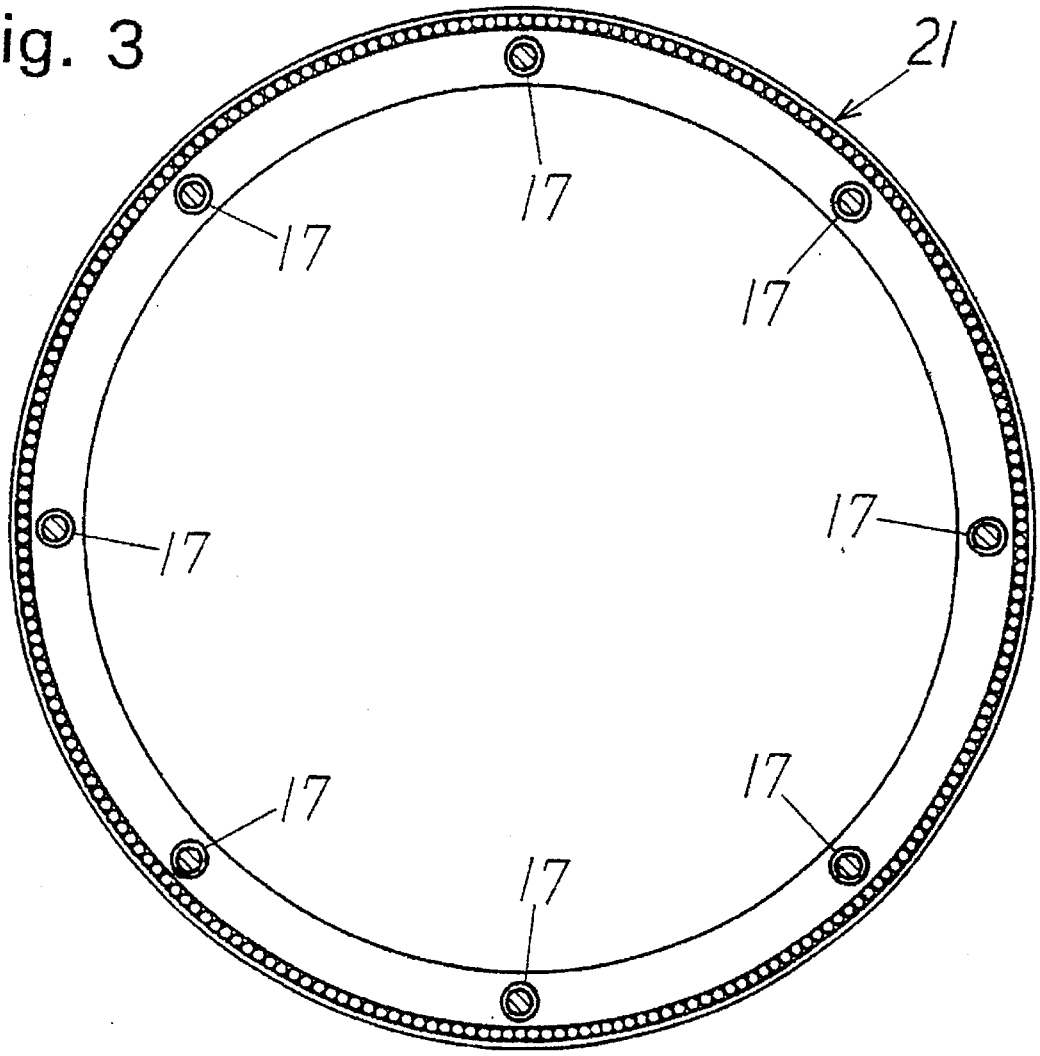
FIG. 3 is a schematic section view taken along line 3—3 in FIG. 2.
Figure 5:
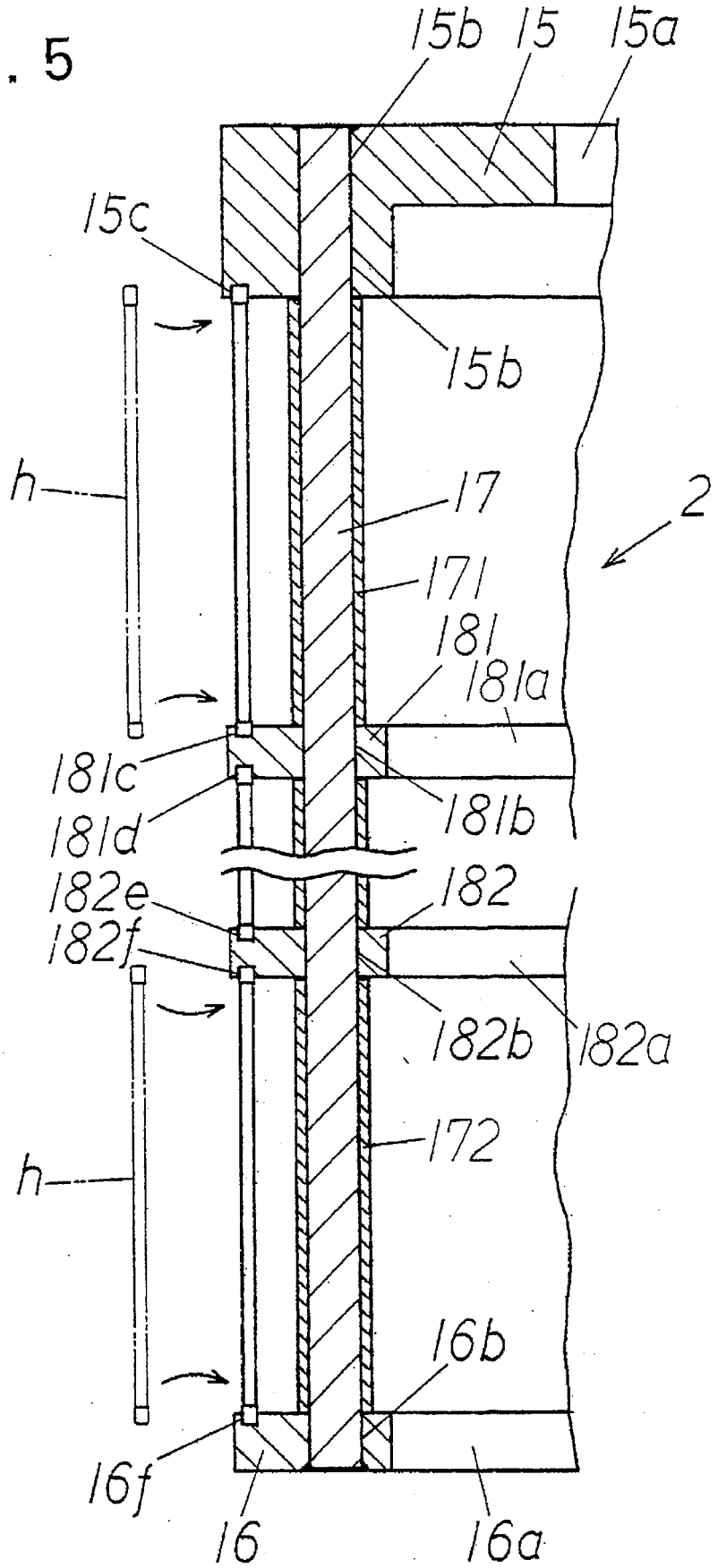
FIG. 5 is a partially enlarged schematic section view of FIG. 2.

Reference numeral 17 represents space holding members, which are provided in plural, for example eight, as shown in FIG. 3. Each of the space holding members 17 is fixed by welding to the first supporting member 15 at one end and to the second supporting member 16 at the other end to thereby hold or form a space between the first supporting member 15 and the second supporting member 16, as shown in FIGS. 2 and 5.

The space holding members 17 are made of, for example, stainless steel, iron, resin or the like. Preferably, on a periphery of the space holding member 17, in order to keep spaces adjacent to each other, span holding members, more specifically, pipes 171, 172, 173, 174 may be provided for the respective spaces, in addition to the space holding members 17. Incidentally, under certain circumstances, the span holding members 171, 172, 173, 174 may be omitted.

Figure 4:
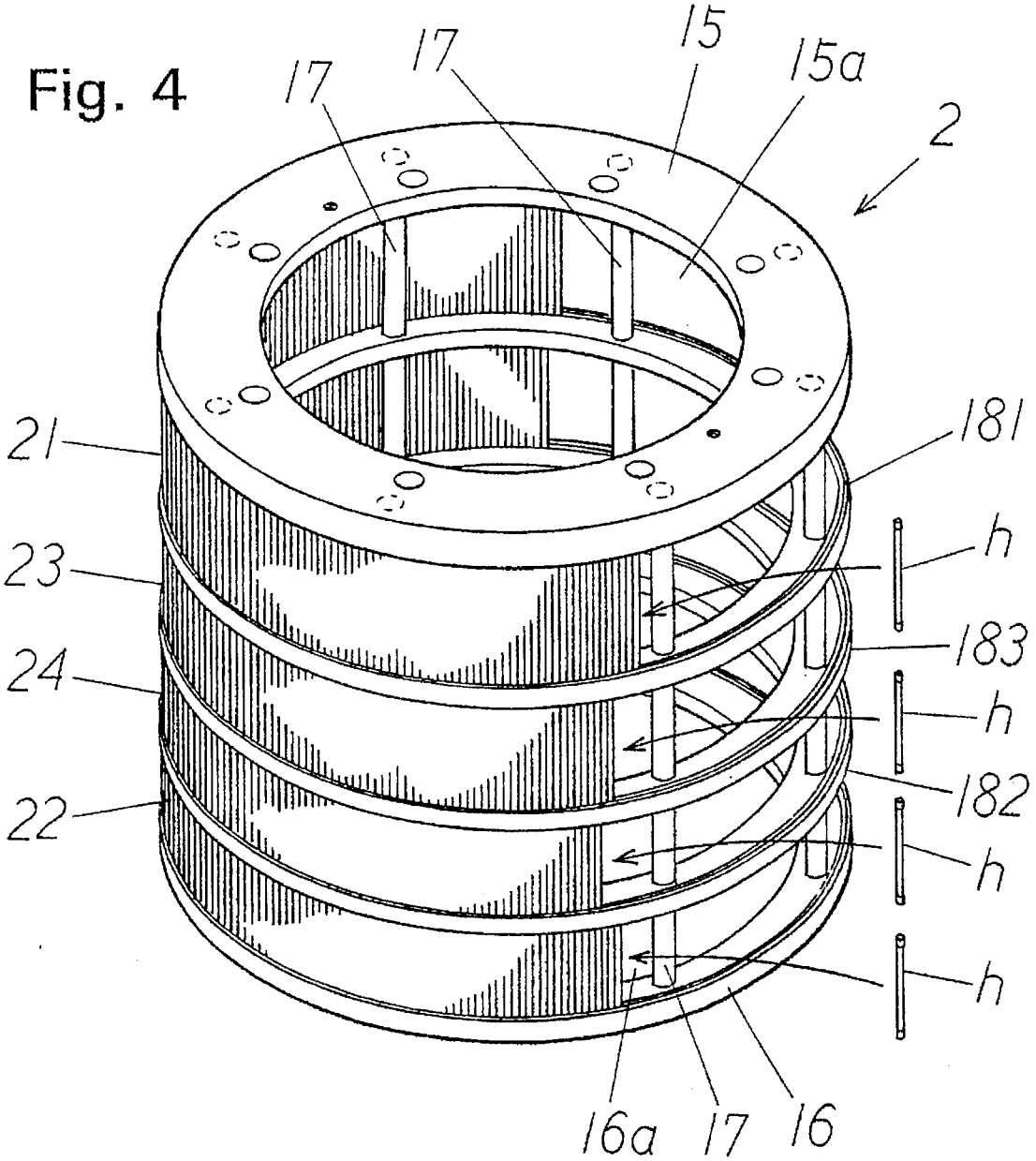
FIG. 4 is an explanatory perspective view for explaining a process for producing a papermaking screen by incorporating longitudinally extending members.

Further, between the first supporting member 15 and the second supporting member 16, n ($n \geqq 2$, in the present embodiment, 3) pieces of intermediate supporting members 181, 183, 182 are disposed in order from a side of the first supporting member 15 with a space therebetween, as shown in FIGS. 2 and 4. The intermediate supporting members 181, 183, 182 have insertion holes 181*b*, 183*b*, 182*b* through which the space holding member 17 passes, respectively, and are provided with annular recesses 181*c*, 183*d*, 182*e*, 181*d*, 183*e*, 182*f* outside the insertion holes 181*b*, 183*b*, 182*b*, respectively. Namely, the intermediate supporting member 181 has the recess 181*c* on one side and the recess 181*d* on the other side thereof (FIGS. 2 and 8–10); the intermediate supporting member 183 has the recess 183*d* on one side and the recess 183*e* on the other side thereof; and the intermediate supporting member 182 has the recess 182*e* on one side and the recess 182*f* on the other side thereof, respectively.

Also, the intermediate supporting members 181, 183, 182 are provided with central openings 181*a*, 183*a*, 182*a*, respectively.

Reference numeral 21 represents a first longitudinally extending member group. The first longitudinally extending member group 21 comprises longitudinally extending members h, each of which has a cross section of, for example, a circular shape, a diameter of about 2.5 mm to about 6.0 mm, and length of about 100 mm to about 200 mm. Each of the longitudinally extending members h is engaged with the annular recess 15*c* of the first supporting member 15 at one end and with the annular recess 181*c* of the intermediate supporting member 181 adjacent to the first supporting member 15 at the other end. At the same time, the members h are disposed parallel along the recess 181*c* in an annular shape for, e.g. 200 pieces to 1,500 pieces, as shown in FIGS. 2 and 4.

The annular recess 15*c* of the first supporting member 15 and the annular recess 181*c* of the intermediate supporting member 181 adjacent to the first supporting member 15 are provided on facing sides of the first supporting member 15 and the intermediate supporting member 181 adjacent to the first supporting member 15.

Figure 13:
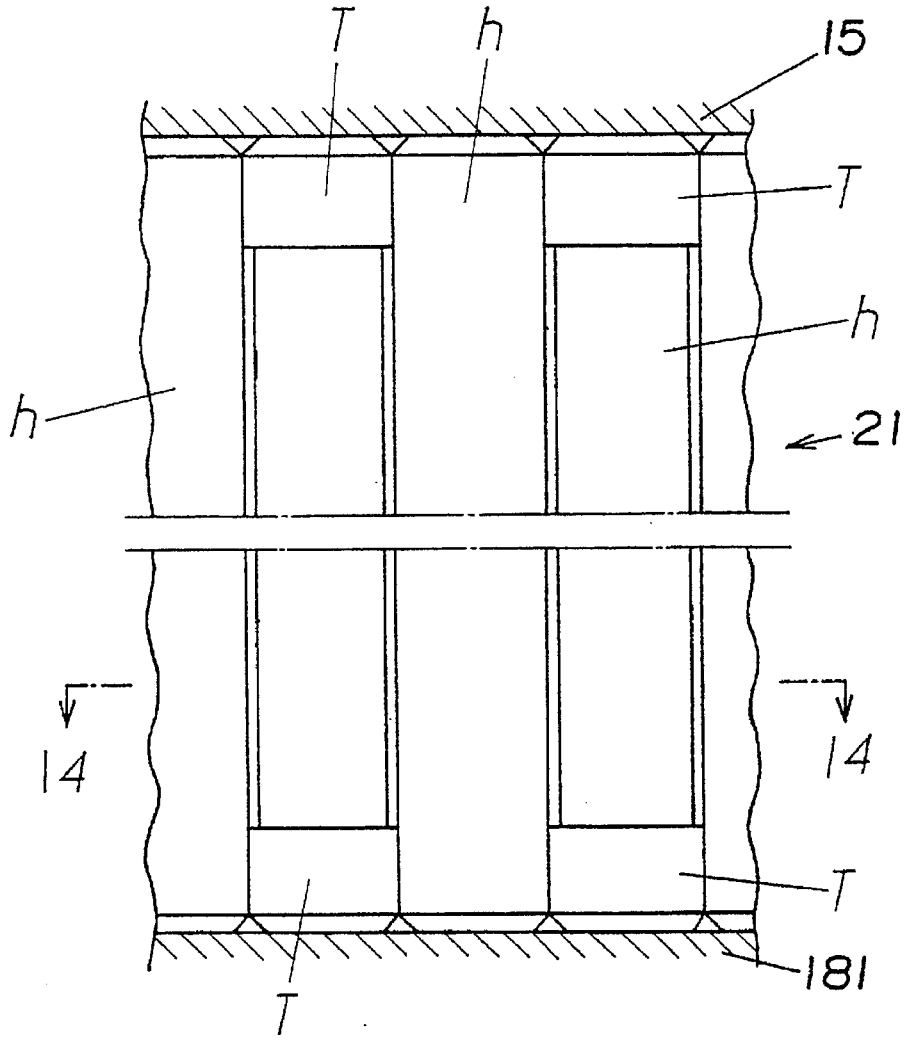
FIG. 13 is a schematic perspective view showing a state of the longitudinally extending members which are disposed in parallel.
Figure 14:
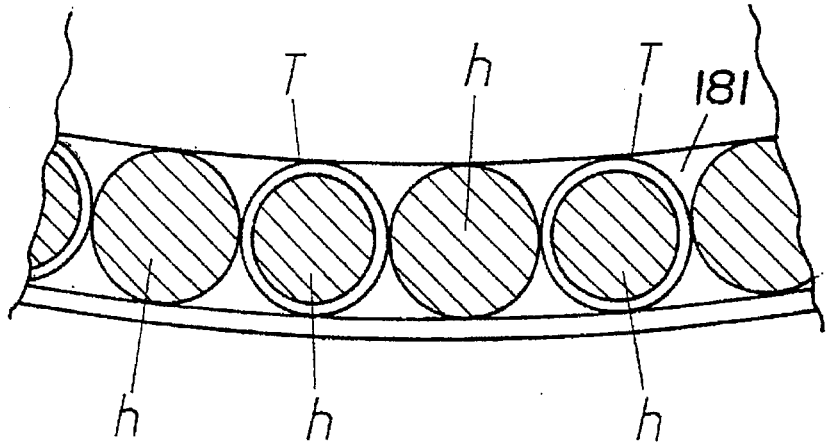
FIG. 14 is a schematic section view taking along line 14—14 in FIG. 13.

The first longitudinally extending member group 21 comprises the longitudinally extending members h disposed parallel in an annular shape, and in order to make a space S between the adjacent longitudinally extending members h, as shown in FIGS. 13 and 14, one of the two adjacent longitudinally extending members h is provided with projections T, with which the other of the adjacent longitudinally extending members h without the projections is contacted. Namely, the longitudinally extending members h are sequentially arranged in the order of the longitudinally extending member h with the projections T, the longitudinally extending member h without the projections T, the longitudinally extending member h with the projections T, and so on.

The longitudinally extending member h with the projections T is made of stainless steel or iron, and has, for example, a circular shape in cross section with a diameter of about 2.5 mm to about 6.0 mm, and a height of the projection T of about 0.05 mm to about 0.50 mm, which is determined according to kinds of papermaking materials to be cleaned, foreign materials contained in the papermaking materials and so on.

Figure 29:
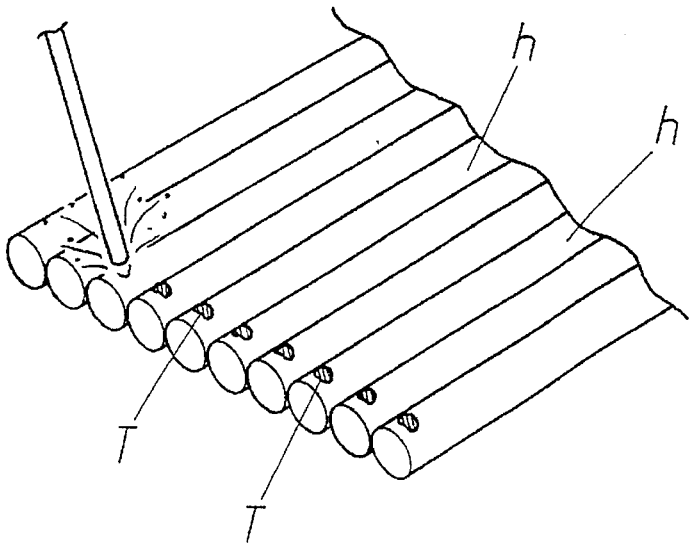
FIG. 29 is an explanatory view for explaining a process for forming projections on longitudinally extending members.
Figure 30:
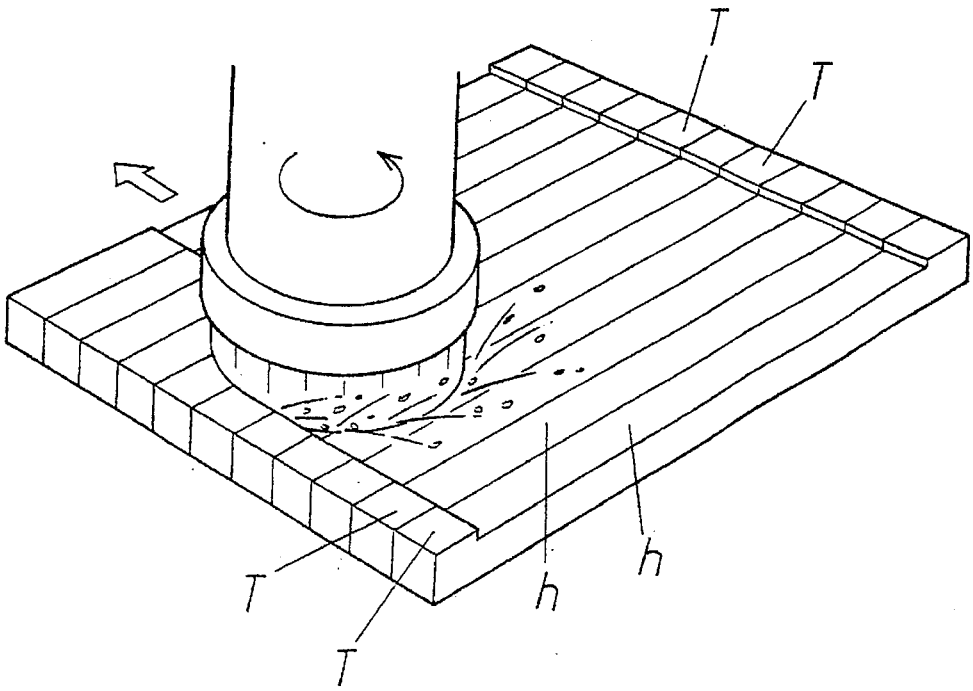
FIG. 30 is an explanatory view for explaining a process for forming projections on the longitudinally extending members, of an embodiment other than the embodiment shown in FIG. 29.

As means for forming the projections T, for example, there are an electropolishing method wherein the longitudinally extending member h is covered with a tape at a portion, i.e., projection T, which is not desired to be melted, then dipped into an acid solution, and charged with electricity to thereby electrochemically grind the surface thereof; a metal deposition method for melt-depositing a part of metal, as shown in FIG. 29; a cutting method for cutting by leaving a portion, as shown in FIG. 30; and a plating method.

Also, the longitudinally extending member h without the projections T is made of a stainless steel or iron having, for example, a circular shape in cross section, a diameter of which is about 2.5 mm to about 6.0 mm.

Figure 15:
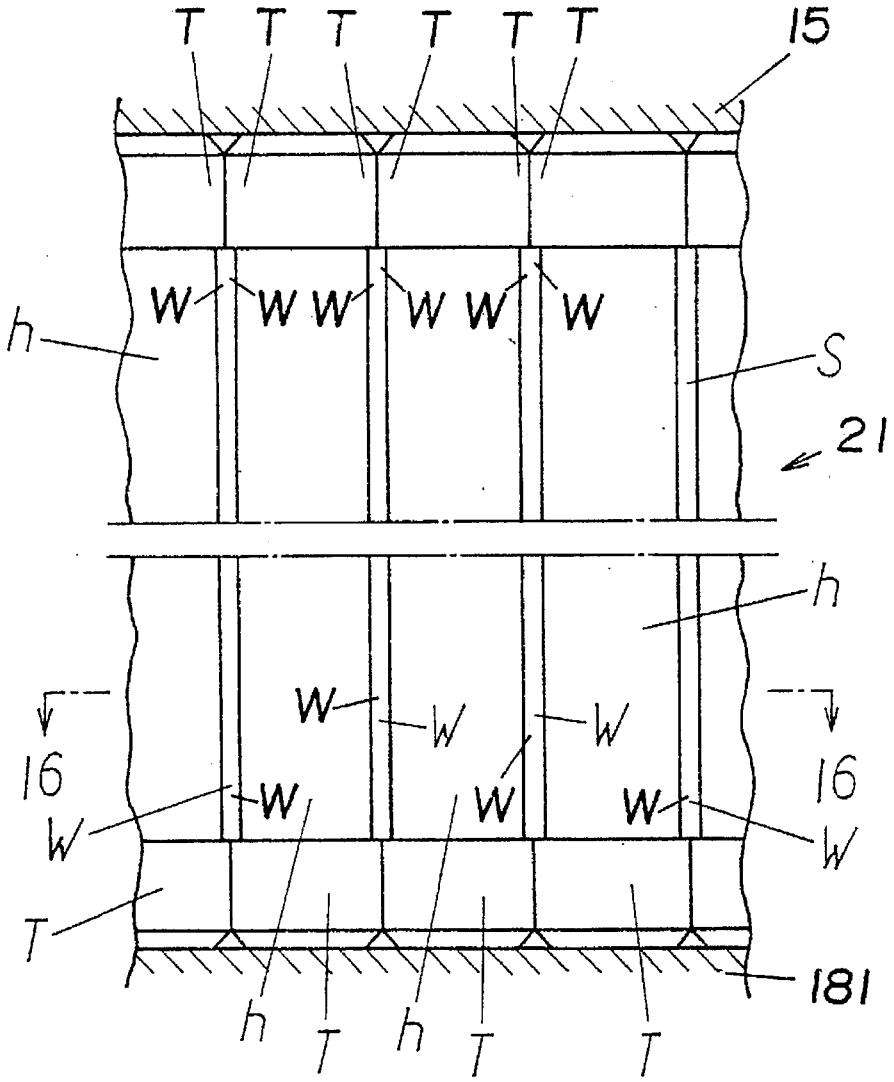
FIG. 15 is a schematic section view showing a state of the longitudinally extending members which are disposed in parallel, of an embodiment other than the embodiment shown in FIG. 13.
Figure 16:
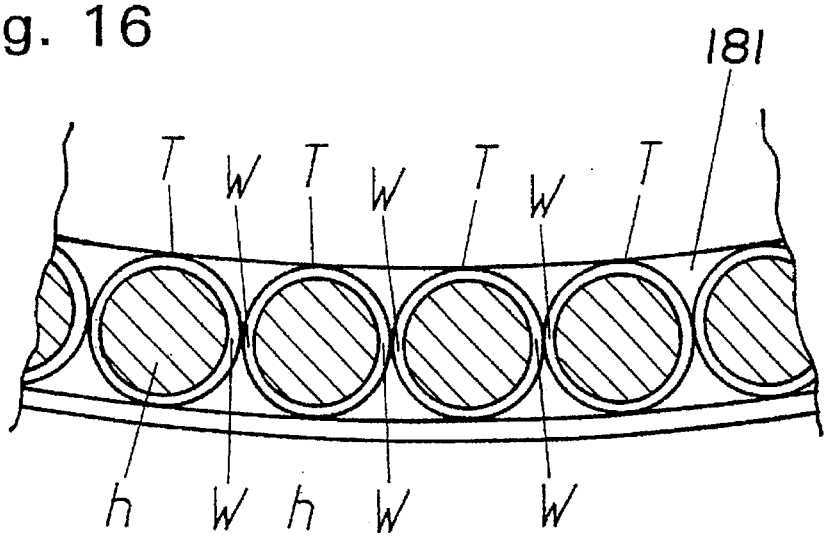
FIG. 16 is a schematic section view taken along line 16—16 in FIG. 15.

Incidentally, as a mode for contacting the adjacent longitudinally extending members h, in addition to the mode shown in FIGS. 13 and 14 wherein the projections T are provided on both ends of a longitudinally extending member h, for example, though not shown, only one projection T may be provided in the center thereof. Also, for example, in arranging the longitudinally extending members h parallel in an annular shape, in order to make a space between the adjacent longitudinally extending members h, as shown in FIGS. 15 and 16, one of the adjacent longitudinally extending members h may be provided with projections T and a recess W, and the other thereof may be also provided with projections T and a recess W so that the recess W of one of the adjacent longitudinal members h faces the recess W of the other thereof, and the projections T of one of the adjacent longitudinally extending members h contact the projections T of the other thereof.

Figure 17:
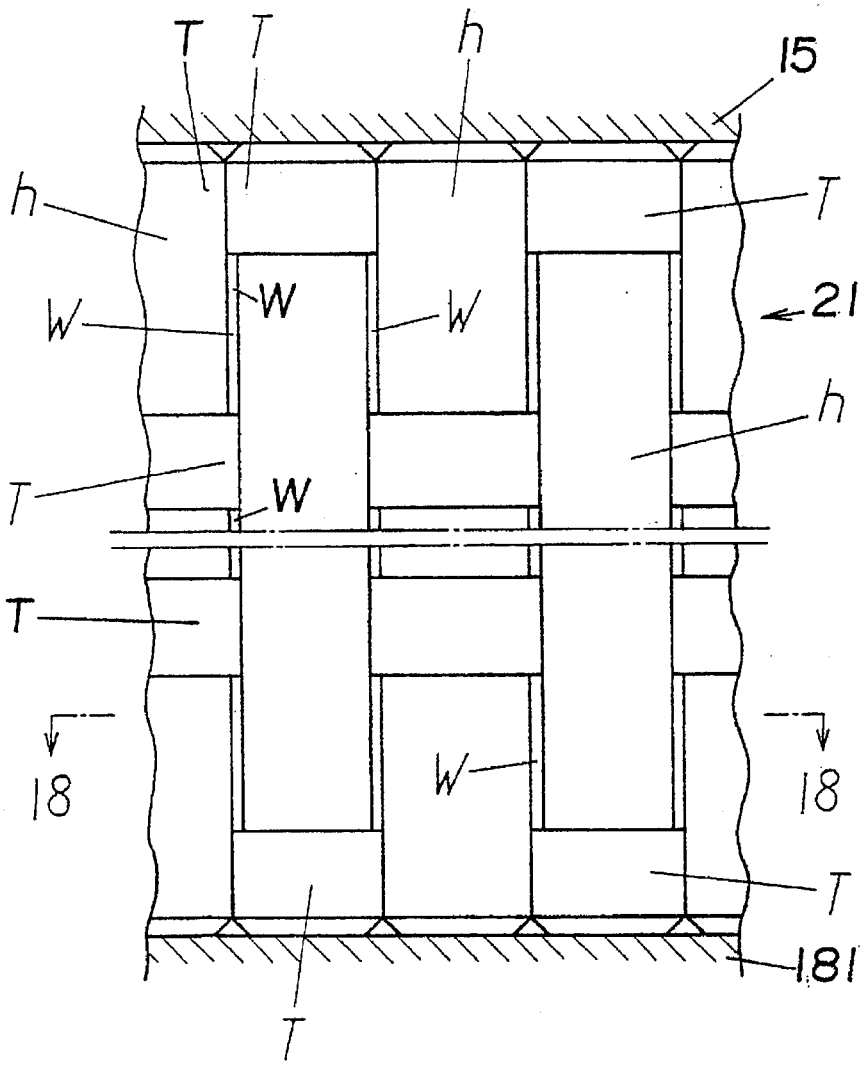
FIG. 17 is a schematic section view showing a state of the longitudinally extending members which are disposed in parallel, of an embodiment other than the embodiment shown in FIG. 13.
Figure 18:
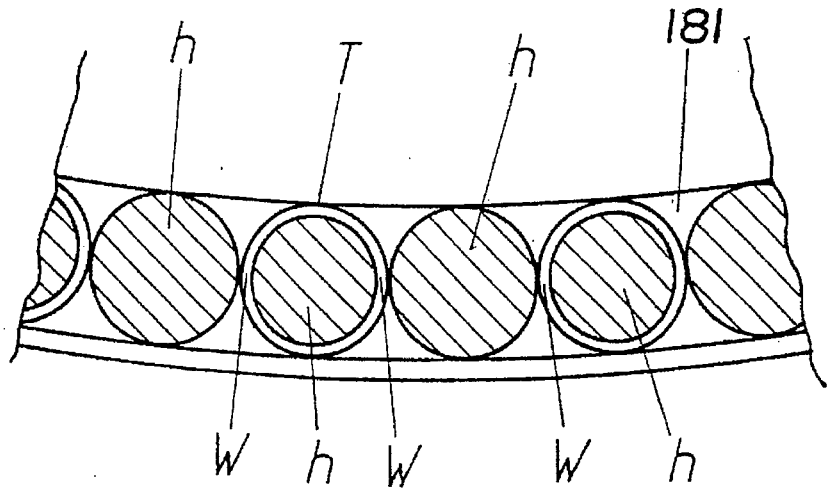
FIG. 18 is a schematic section view taken along line 18—18 in FIG. 17.

Also, as shown in FIGS. 17 and 18, one of the adjacent longitudinally extending members h may be provided with projections T and a recess W, and the other thereof may also be provided with projections T and recesses W so that the projections T of one of the adjacent longitudinally extending members h contact the recesses W of the other thereof, and the recess W of the one of the adjacent longitudinal members h contacts the projections T of the other thereof.

Also, a second longitudinally extending member group 22 is located between the second supporting member 16 and the intermediate supporting member 182*b* adjacent to the second supporting member 16, as shown in FIGS. 2, 4 and 5.

The second longitudinally extending member group 22 comprises longitudinally extending members h, wherein one end of the member h is engaged with an annular recess 16*f* formed on the second supporting member 16 and the other end is engaged with an annular recess 182*f* formed on the intermediate supporting member 182 adjacent to the second supporting member 16. The longitudinally extending members h are arranged parallel in an annular shape. The second longitudinally extending member group 22 is arranged in the same manner as in the first longitudinally extending member group 21 except for the engaging positions of the longitudinally extending members h. Namely, in the first longitudinally extending member group 21, one end of the longitudinally extending member h is engaged with the recess 15*c* and the other end thereof is engaged with the recess 181*c*, while in the second longitudinally extending member group 22, one end of the longitudinally extending member h is engaged with the recess 16*f* and the other end thereof is engaged with the recess 182*f*.

More specifically, the annular recess 16*f* formed on the second supporting member 16 and the annular recess 182*f* formed on the intermediate supporting member 182 adjacent to the second supporting member 16 are provided on facing sides of the second supporting member 16 and the intermediate supporting member 182 adjacent to the second supporting member 16.

The second longitudinally extending member group 22 is arranged parallel in an annular shape, and in order to make a space between one of the adjacent longitudinally extending members h and the other thereof, in the same manner as in the first longitudinally extending member group 21, one of the adjacent longitudinally extending members h is provided with projections T, and the projections T are contacted with the other of the adjacent longitudinally extending members h. One of the adjacent longitudinally extending members h may be provided with projections T and a recess W, and the other of the adjacent longitudinally extending members h may be provided with projections T and a recess W so that the recess W of one of the adjacent longitudinally extending members h and the recess W of the other of the adjacent longitudinally extending members h face against each other, and the projections T of one of the adjacent longitudinally extending members h and the projections T of the other of the adjacent longitudinally extending members h are contacted with each other. Also, one of the adjacent longitudinally extending members h may be provided with projections T and a recess W, and the other of the adjacent longitudinally extending members h may be provided with projections T and recesses W so that the projections T of one of the adjacent longitudinally extending members h contact the recesses W of the other of the adjacent longitudinally extending members h, and the recess W of the one of the adjacent longitudinally extending members h contact the projections T of the other of the adjacent longitudinal members h.

Also, n ($n \geqq 2$) pieces of intermediate supporting members, e.g. three intermediate supporting members 181, 182, 183 in the present embodiment, are provided, and as shown in FIG. 2, annular recesses 181*d*, 183*d*, 183*e*, 182*e* are provided on the respective facing sides of the intermediate supporting members 181, 182, 183.

The respective facing intermediate supporting members, more specifically, the intermediate supporting members 181 and 183 and the intermediate supporting members 183 and 182 are provided with annular recesses on the respective facing sides thereof. Namely, an annular recess 181*d* and an annular recess 183*d* for the intermediate supporting members 181 and 183, and an annular recess 183*e* and an annular recess 182*e* for the intermediate supporting members 183 and 182 are provided.

And, a longitudinally extending member group is disposed between the intermediate supporting members, that is, between respective facing intermediate supporting members, and in case of n ($n \geqq 2$) pieces of intermediate supporting members, (n−1) longitudinally extending member groups are provided. In the present embodiment, 2 longitudinally extending member groups are provided.

The longitudinally extending member group 23 or 24, as shown in FIG. 2, comprises longitudinally extending members h. One end of each of the members h; is engaged with the annular recess 181*d* or 183*e* formed on the intermediate supporting member 181 or 183, and the other end of each of the members h is engaged with the annular recess 183*d* or 182*e* formed on the intermediate supporting member 183 or 182 adjacent to the intermediate supporting member 181 or 183 so that the longitudinal supporting members h are arranged parallel in an annular shape.

In the longitudinally extending member groups 23, 24 of (n−1) groups, i.e. two groups in the present embodiment, each of the longitudinally extending member groups 23, 24 is formed, in the same manner as in the first longitudinally extending member group 21, such that one of the adjacent longitudinally extending members h is provided with projections T, and the other of the adjacent longitudinally extending members h is contacted with the projections T. One of the adjacent longitudinally extending members h may be provided with projections T and a recess W, and the other of the adjacent longitudinally extending members h may be provided with projections T and a recess W, respectively, wherein the recess W of one of the adjacent longitudinally extending members h and the recess W of the other of the adjacent longitudinally extending members h face against each other, and the projections T of one of the adjacent longitudinally extending members h and the projections T of the other of the adjacent longitudinally extending members h are contacted with each other. Also, one of the adjacent longitudinally extending members h may be provided with projections T and the recess W, the other of the adjacent longitudinally extending members h may be provided with projections T and recesses W, respectively, wherein the projections T of one of the adjacent longitudinally extending members h and the recesses of the other of the adjacent longitudinally extending members h are contacted with each other, and the recess of one of the adjacent longitudinally extending members h and the projection of the other of the adjacent longitudinally extending members h are contacted with each other.

Also, the papermaking screen 2 is provided with a plurality of space holding members 17, each of which passes through the through holes 181*b*, 183*b*, 182*b* of the intermediate supporting members 181, 183, 182 therethrough, and fixed to the first supporting member 15 at one end and fixed to the second supporting member 16 at the other end to thereby hold the spaces between the first supporting member 15 and the second supporting member 16.

And, at least, the intermediate supporting member 181 adjacent to the first supporting member 15 is sandwiched by the first longitudinally extending member group 21 and the longitudinally extending member group 23 adjacent to the first longitudinally extending member group 21, and the intermediate supporting member 182 adjacent to the second supporting member 16 is sandwiched by the second longitudinally extending member group 22 and the longitudinally extending member group 24 adjacent to the second longitudinally extending member group 22. In the present embodiment, further, the intermediate supporting member 183 is sandwiched by the longitudinally extending member groups 23 and 24. In the first longitudinally extending member group 21, the second longitudinally extending member group 22, and the longitudinally extending member groups 23 and 24, each member group is formed such that the space S is formed between one of the adjacent longitudinally extending member h and the other thereof, respectively.

Figure 31:
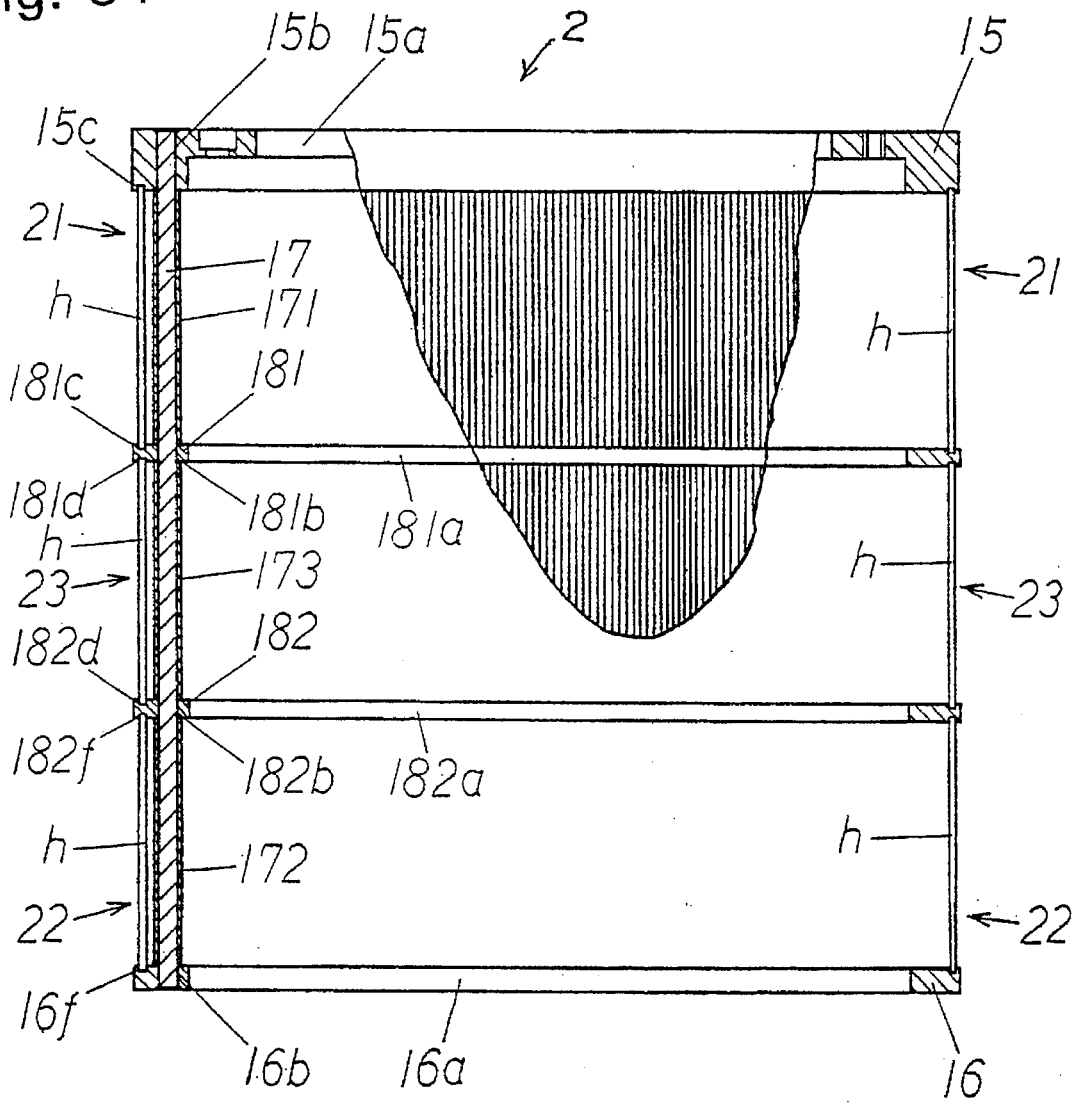
FIG. 31 is a schematic section view of an embodiment other than the papermaking screen shown in FIG. 2.

In the above-described embodiment, as a representative example for n pieces of the intermediate supporting members ($n \geqq 2$), an example with the three intermediate supporting members has been explained. However, an example with the two intermediate supporting members as shown in FIG. 31 can also be applied in the same manner by omitting the intermediate supporting member 183 and the longitudinally extending member group 24 from the above embodiment as shown, for example, in FIG. 2.

Figure 32:
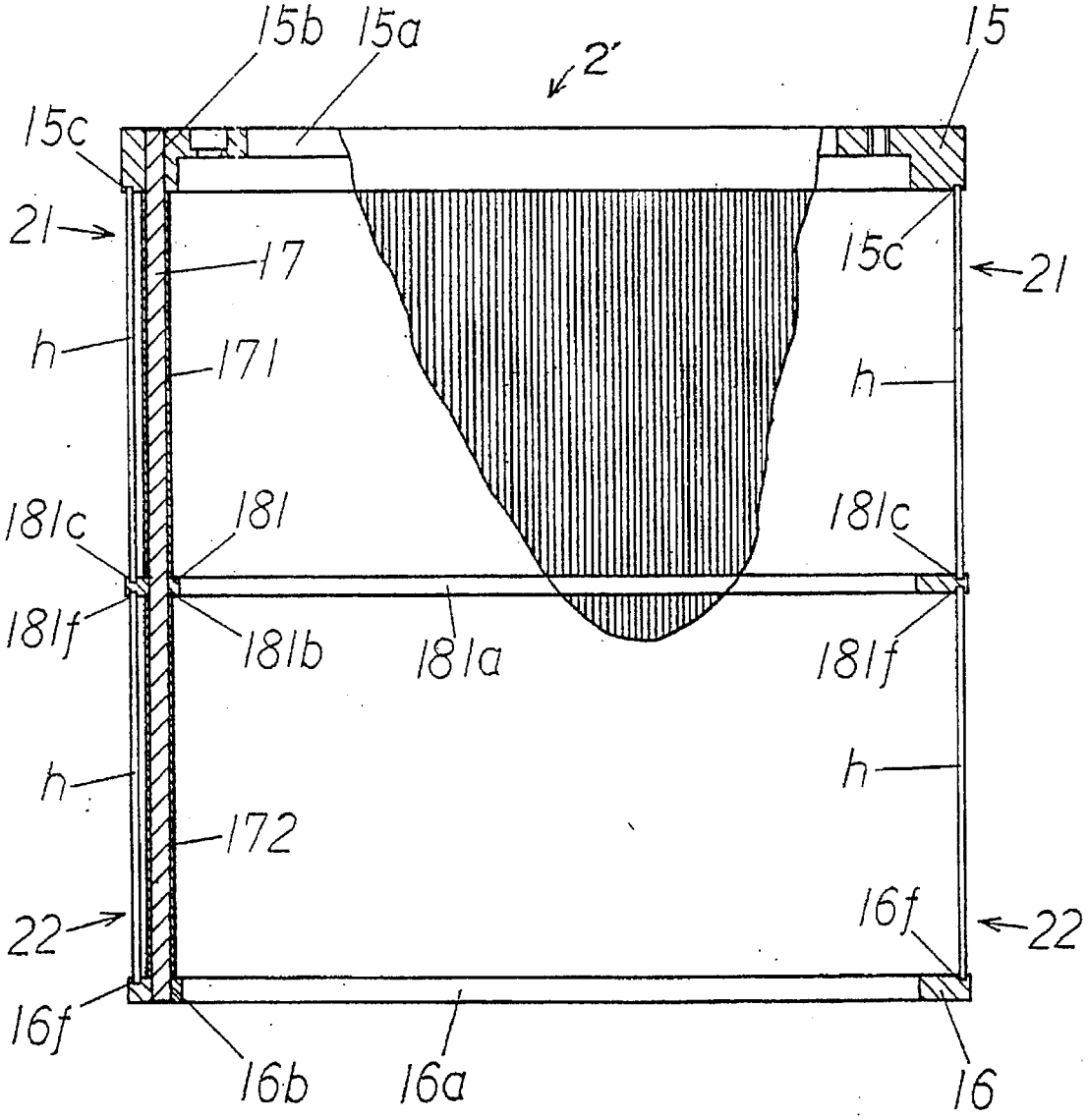
FIG. 32 is a schematic section view of an embodiment other than the papermaking screen shown in FIG. 2.

Also, an example with one intermediate supporting member, as shown in FIG. 32, can be applied in the same manner by omitting the intermediate supporting members 183, 182 and the longitudinally extending member groups 23, 24 from the papermaking screen 2 as shown in FIGS. 1 through 18.

More specifically, a papermaking screen 2' is formed of a plurality of space holding members 17, each being fixed to the first supporting member 15 at one end and fixed to the second supporting member 16 at the other end thereof to thereby hold a space between the first supporting member 15 and the second supporting member 16.

And, an intermediate supporting member 181 is disposed between the first supporting member 15 and the second supporting member 16, and has through holes 181*b* for inserting the space holding members 17 therethrough. Also, the intermediate supporting member 181 has an opening 181*a* provided at the center portion thereof.

The first longitudinally extending member group 21 is located between the first supporting member 15 and the intermediate supporting member 181. The first longitudinally extending member group 21 comprises longitudinally extending members h, and is engaged at one end with an annular recess 15*c* formed on the first supporting member 15 and engaged at the other end thereof with an annular recess 181*c* formed on the intermediate supporting member 181. The longitudinally extending members h are arranged parallel along the recess 181*c* in an annular shape.

The recess 15*c* formed in an annular shape on the first supporting member 15 and the recess 181*c* formed in an annular shape on the intermediate supporting member 181 are arranged on the facing sides of the first supporting member 15 and the intermediate supporting member 181.

And, in the first longitudinally extending member group 21, as shown in FIGS. 13 through 18, the longitudinally extending members h are arranged parallel in an annular shape. In order to make a space S between one of the adjacent longitudinally extending members h and the other thereof, one of the adjacent longitudinally extending members h is provided with projections T, and the projections T are attached to the other of the adjacent longitudinally extending members h. And, these longitudinally extending members are sequentially arranged in the order of the longitudinally extending member h with the projections T, the longitudinally extending member h without the projections T, the longitudinally extending member h with the projections T, the longitudinally extending member h without the projections T and so on.

Incidentally, as a mode for contacting the adjacent longitudinally extending members h with each other, in addition to the above described example, for example, the longitudinally extending members h are arranged parallel in an annular shape. In order to make a space between one of the adjacent longitudinally extending members h and the other thereof, one of the adjacent longitudinally extending members h may be provided with projections T and a recess W, and the other thereof may be provided with projections T and a recess W, wherein the recess W of the one of the adjacent longitudinally extending members h faces the recess of the other thereof, and the projections T of one of the adjacent longitudinally extending members h contact the projections T of the other thereof. Also, one of the adjacent longitudinally extending members h may be provided with projections T and recesses W, and the other thereof may be provided with projections T and a recess W, wherein the projections T of one of the adjacent longitudinally extending members h and the recess W of the other thereof are contacted with each other, and the recesses W of one of the adjacent longitudinally extending members h and the projections T of the other thereof are contacted with each other.

Also, a second longitudinally extending member group 22 is disposed between the second supporting member 16 and the intermediate supporting member 181.

The second longitudinally extending member group 22 comprises longitudinally extending members h, and is engaged at one end with an annular recess 16*f* formed on the second supporting member 16 and engaged at the other end with an annular recess 181*f* formed on the intermediate supporting member 181 so that the longitudinally extending members h are arranged parallel in an annular shape. The second longitudinally extending member group 22 is provided in the same manner as in the first longitudinally extending member group 21 except for engaging positions of the longitudinally extending members h. Namely, in the first longitudinally extending member group 21, one end of each of the longitudinally extending members h is engaged with the recess 15*c* and the other end thereof is engaged with the recess 181*c*, while in the second longitudinally extending member group 22, one end of each of the longitudinally extending members h is engaged with the recess 16*f* and the other end of each of the longitudinally extending members h is engaged with the recess 181*f*.

More specifically, the annular recess 16*f* formed on the second supporting member 16 and the annular recess 181*f* formed on the intermediate supporting member 181 are provided on the facing sides of the second supporting member 16 and the intermediate supporting member 181, respectively.

And, the second longitudinally extending member group 22 is disposed parallel in an annular shape, and in order to make a space between one of the adjacent longitudinally extending members h and the other thereof, as in the first longitudinally extending member group 21, one of the adjacent longitudinally extending members h is provided with projections T, and the projections T are contacted with the other member h of the adjacent longitudinally extending members. One of the adjacent longitudinally extending members h may be provided with projections T and a recess W, and the other may be provided with projections T and a recess W, wherein the recess W of one of the adjacent longitudinally extending members h and the recess W of the other thereof face against each other, and the projections T of one of the adjacent longitudinally extending members h and the projections T of the other thereof are contacted with each other. Also, one of the adjacent longitudinally extending members may be provided with projections T and recesses W, and the other thereof may be provided with projections T and a recess W, wherein the projections T of one of the adjacent longitudinally extending members h and the recess W of the other thereof are contacted with each other, and the recesses W of the one of the adjacent longitudinally extending members h and the projections T of the other thereof are contacted with each other.

In the papermaking screen 2', a plurality of space holding members 17 passes through holes 181*b* of the intermediate supporting member 181, and each being fixed to the first supporting member 15 at one end and fixed to the second supporting member 16 at the other end thereof to thereby hold or form a space between the first supporting member 15 and the second supporting member 16.

And, the intermediate supporting member 181 is sandwiched by the first longitudinally extending member group 21 and the second longitudinally extending member group 22, and a space S is formed between one of the adjacent longitudinally extending members h and the other thereof.

Figure 33:
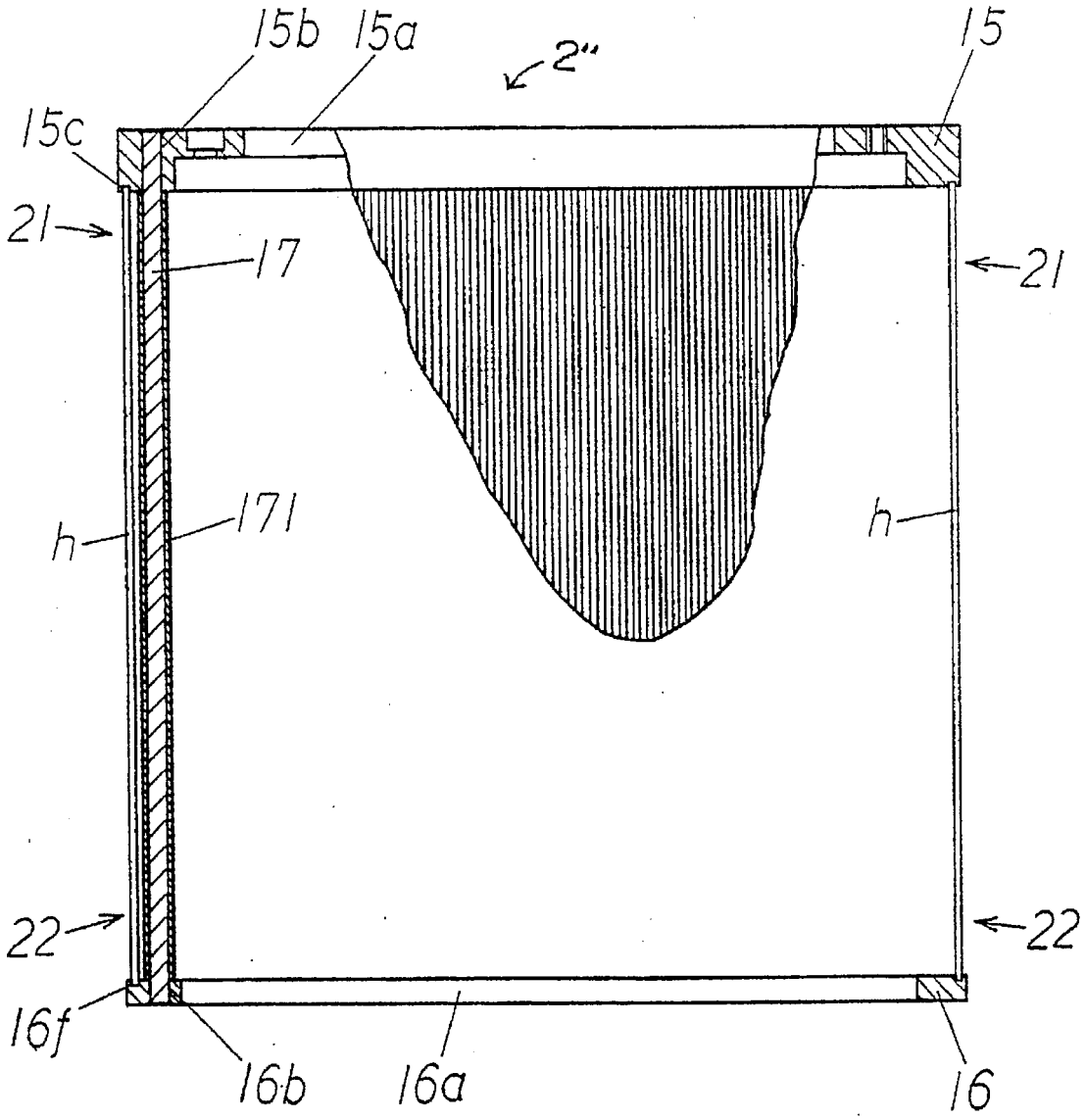
FIG. 33 is a schematic section view of an embodiment other than the papermaking screen shown in FIG. 2.

Also, in case no intermediate supporting member is provided, as shown in FIG. 33, a papermaking screen 2" can be obtained in the same manner by omitting the intermediate supporting members 181, 183, 182, the longitudinally extending member groups 23, 24 and the second longitudinally extending member group 22 from the papermaking screen 2 as shown in FIGS. 1 through 18.

More specifically, the papermaking screen 2" is formed of a plurality of space holding members 17, each being fixed to the first supporting member 15 at one end and fixed to the second supporting member 16 at the other end to thereby hold a space between the first supporting member 15 and the second supporting member 16. And, the first longitudinally extending member group 21 is disposed between the first supporting member 15 and the second supporting member 16.

The first longitudinally extending member group 21 comprises the longitudinally extending members h, and is engaged at one end with the annular recess 15*c* formed on the first supporting member 15 and engaged at the other end with the annular recess 16*f* formed on the second supporting member 16. The longitudinally extending members h are arranged parallel along the recesses 15*c* and 16*f* in an annular shape.

The annular recess 15*c* formed on the first supporting member 15 and the annular recess 16*f* formed on the second supporting member 16 are provided on facing sides of the first supporting member 15 and the second supporting member 16.

And, in the first longitudinally extending member group 21, as shown in FIGS. 13 through 18, the longitudinally extending members h are arranged parallel in an annular shape. In order to make a space S between one of the adjacent longitudinally extending members h and the other thereof, one of the adjacent longitudinally extending members is provided with projections T, and the projections T are attached to the other of the adjacent longitudinally extending members. And, these longitudinally extending members are sequentially arranged in the order of the longitudinally extending member h with the projections T, the longitudinally extending member h without the projections T, the longitudinally extending member h with the projections T, the longitudinally extending member h without the projections T and so on.

Incidentally, as a mode for contacting the adjacent longitudinally extending members with each other, in addition to the above described example, for example, the longitudinally extending members are arranged parallel in an annular shape. In order to make a space between one of the adjacent longitudinally extending members h and the other thereof, one of the adjacent longitudinally extending members h may be provided with projections T and a recess W, and the other of the adjacent longitudinally extending members may be provided with projections T and a recess W, wherein the recess W of one of the adjacent longitudinally extending members h faces the recess W of the other of the adjacent longitudinally extending members, and the respective projections T of one of the adjacent longitudinally extending members h contact the respective projections T of the other of the adjacent longitudinally extending members h. Also, one of the adjacent longitudinally extending members h may be provided with projections T and a recess W, and the other thereof may be provided with projections T and recesses W, wherein the respective projections T of one of the adjacent longitudinally extending members and the respective recesses W of the other thereof are contacted with each other, and the recess W of one of the adjacent longitudinally extending members and the respective projections T of the other thereof are contacted with each other.

The papermaking screen 2" is formed of a plurality of space holding members 17, each being fixed to the first supporting member 15 at one end and fixed to the second supporting member 16 at the other end to thereby hold or form a space between the first supporting member 15 and the second supporting member 16. And, a space S is formed between one of the adjacent longitudinally extending members h and the other thereof.

Figure 34:
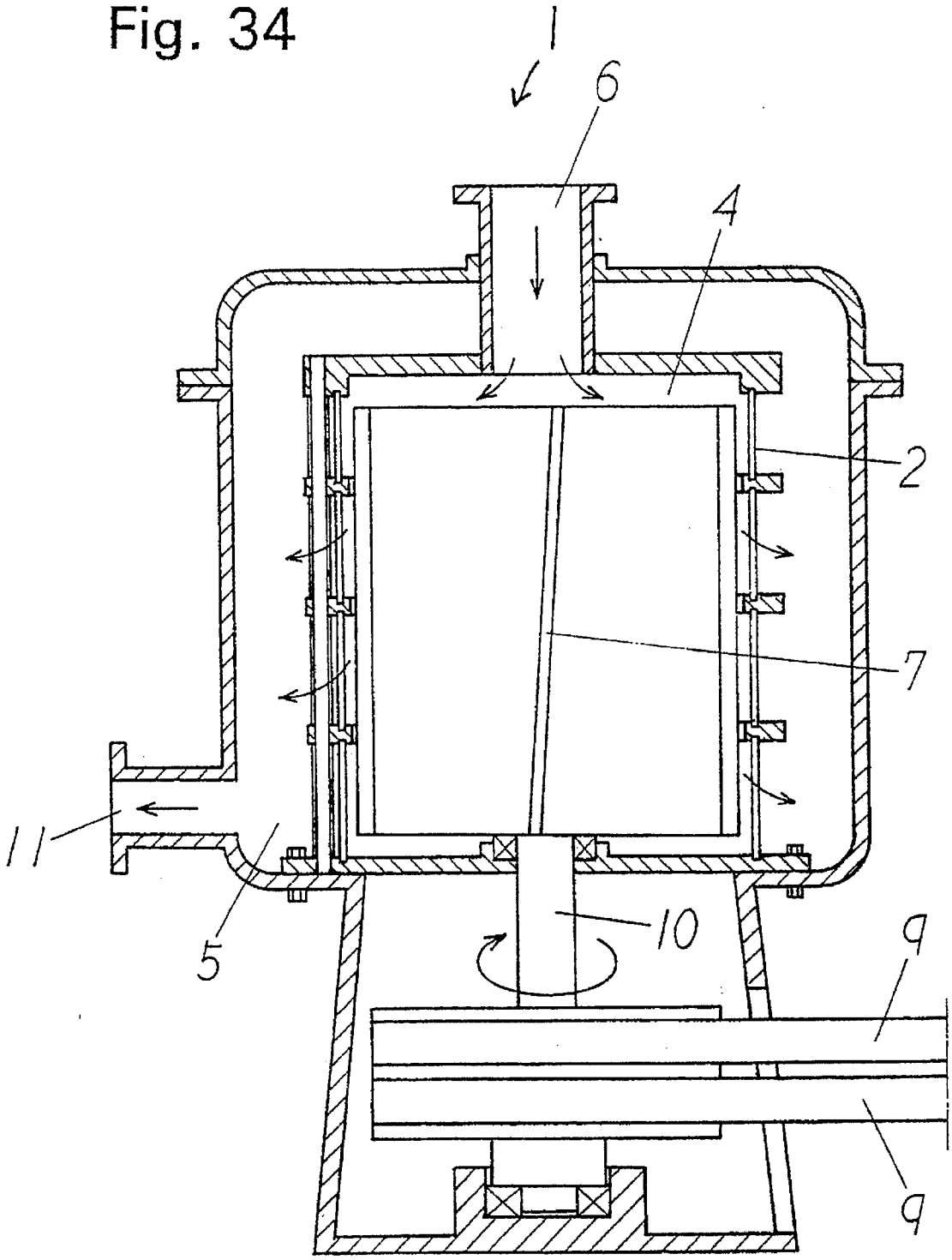
FIG. 34 is a schematic section view of an embodiment other than the papermaking screen device incorporating the papermaking screen shown in FIG. 1.
Figure 35:
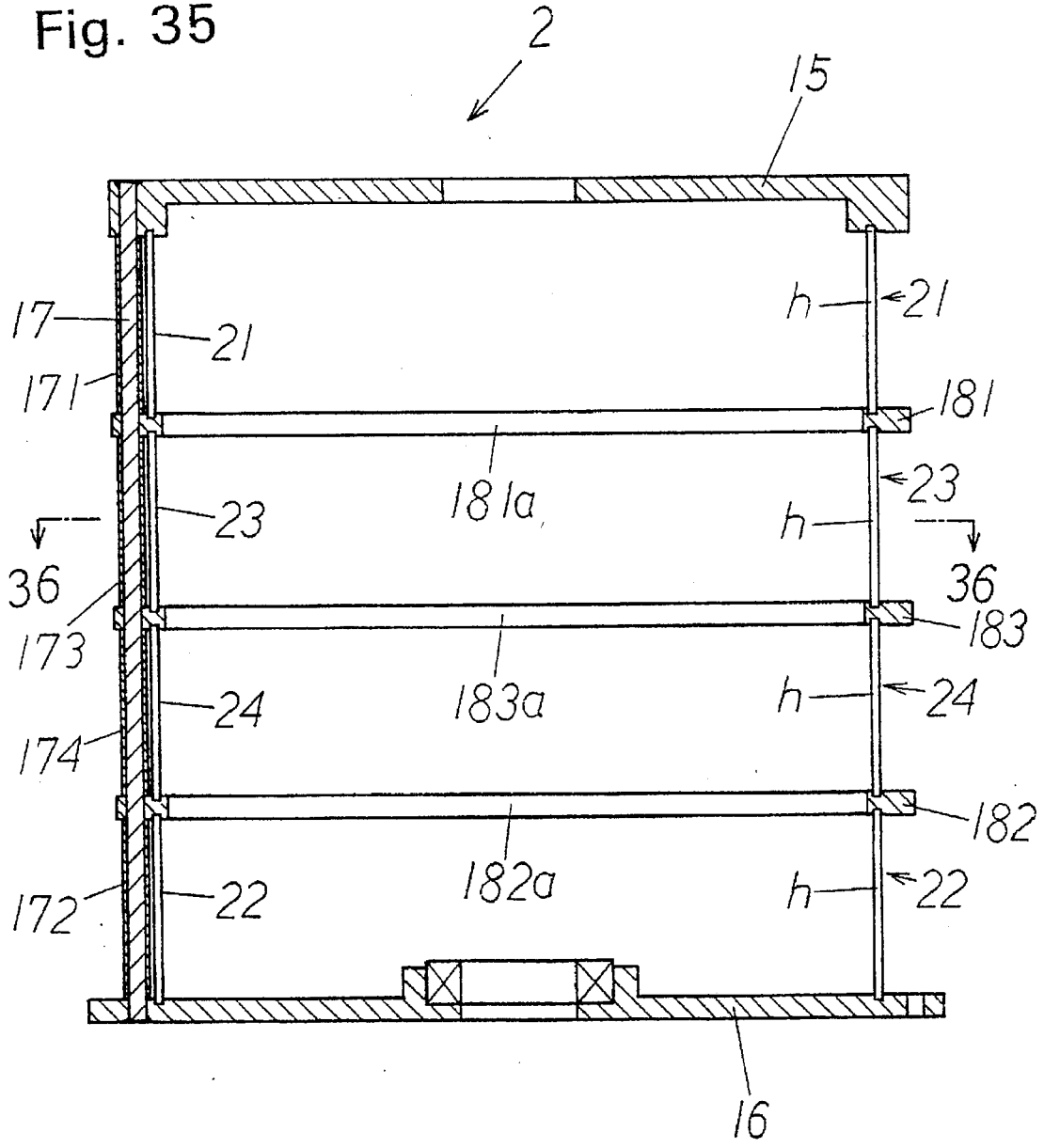
FIG. 35 is a schematic section view of the papermaking screen shown in FIG. 34.
Figure 36:
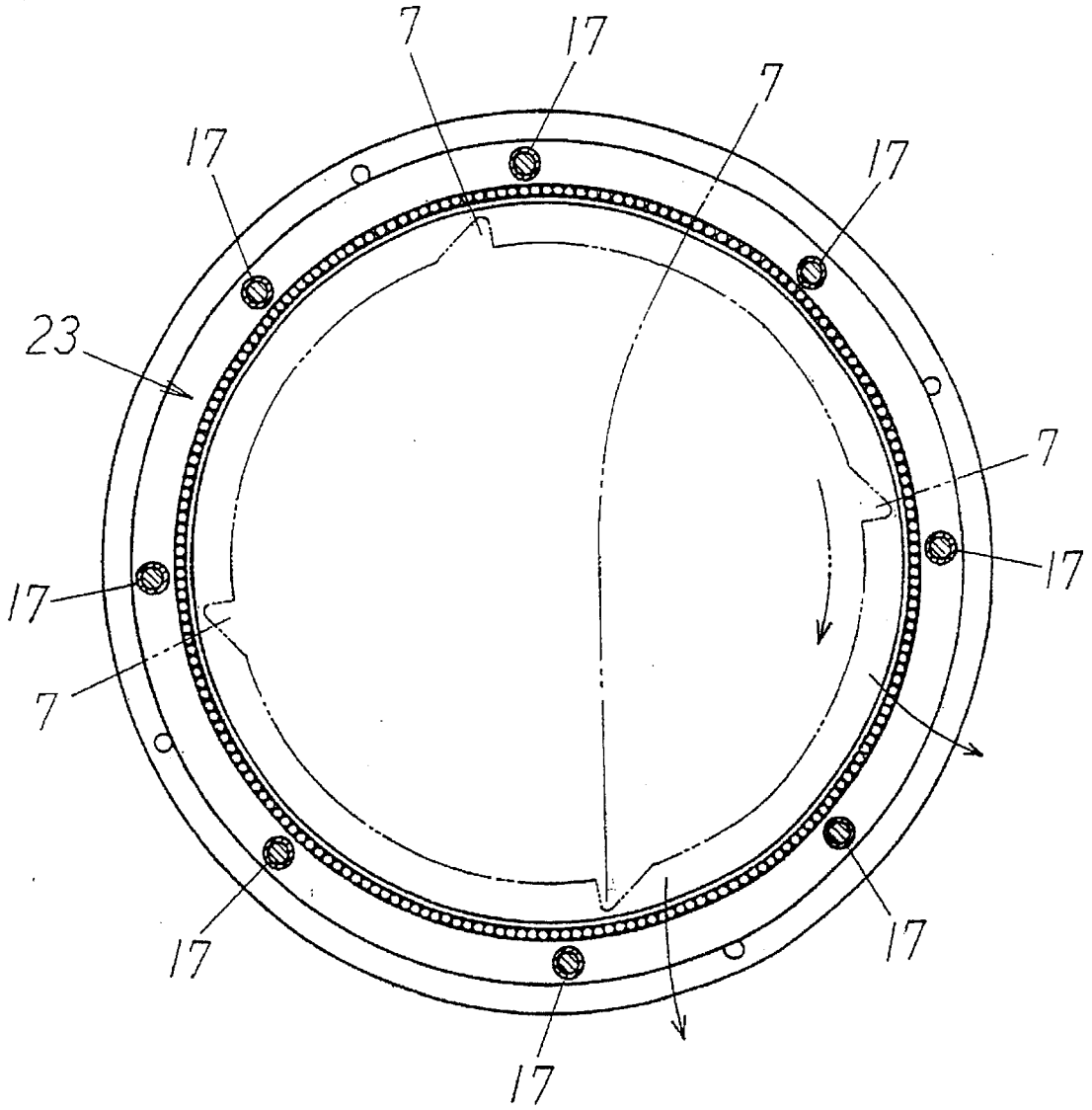
FIG. 36 is a schematic section view taken along line 36—36 shown in FIG. 35.

Incidentally, in the above embodiment, an example where the papermaking screen 2 was applied to a screen device in which a papermaking material flows into an inner portion of the papermaking screen 2 from an outside thereof to thereby clean the papermaking material, was described. However, the papermaking screen 2 according to the present invention, as shown in FIGS. 34 through 36, may also be applied to a centrifugal type screen device wherein a papermaking material flows from an inner portion of the papermaking screen 2 toward an outside thereof to thereby clean the papermaking material. In this case, since good effect can be obtained when an agitator is provided near the longitudinally extending members h, i.e., screen bars, it is desirable to dispose the space holding members 17 outside the longitudinally extending members h, i.e., screen bars, contrary to the example described above.

Incidentally, in the above embodiments, an example where the longitudinally extending member h has a circular section was explained. However, in case both sections of the adjacent longitudinally extending members h are circular, there is a disadvantage such that the space S formed between one of the adjacent longitudinally extending members and the other thereof tends to be uniform due to abrasion at the time of cleaning a papermaking material.

Figure 19:
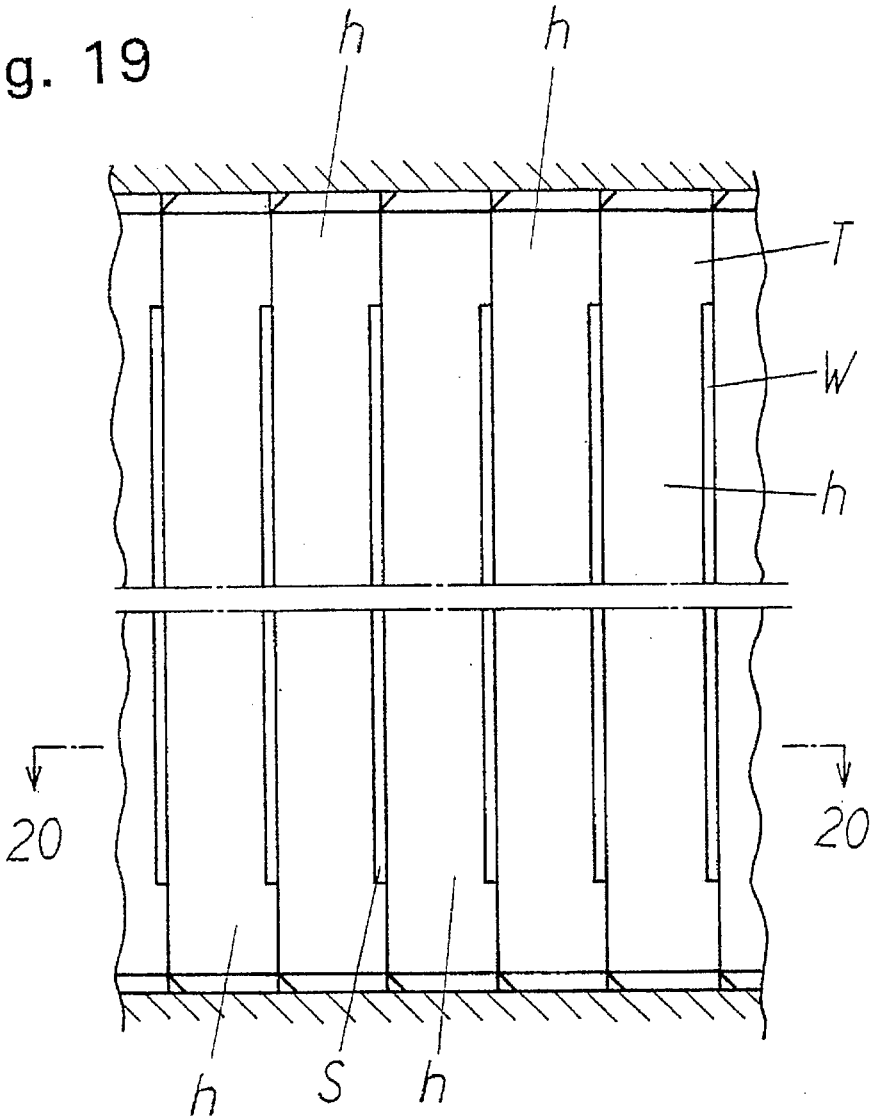
FIG. 19 is a schematic section view showing a state of the longitudinally extending members which are disposed in parallel, of an embodiment other than the embodiment shown in FIG. 13.
Figure 20:
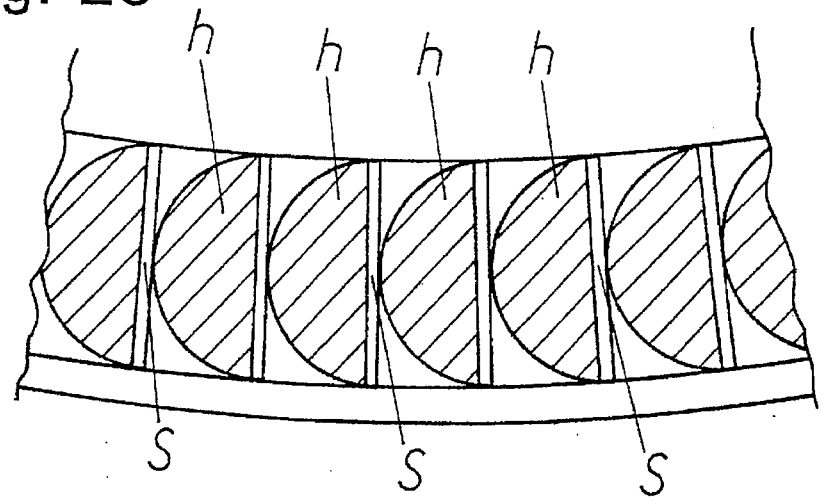
FIG. 20 is a schematic section view taken along line 20—20 in FIG. 19.
Figure 21:
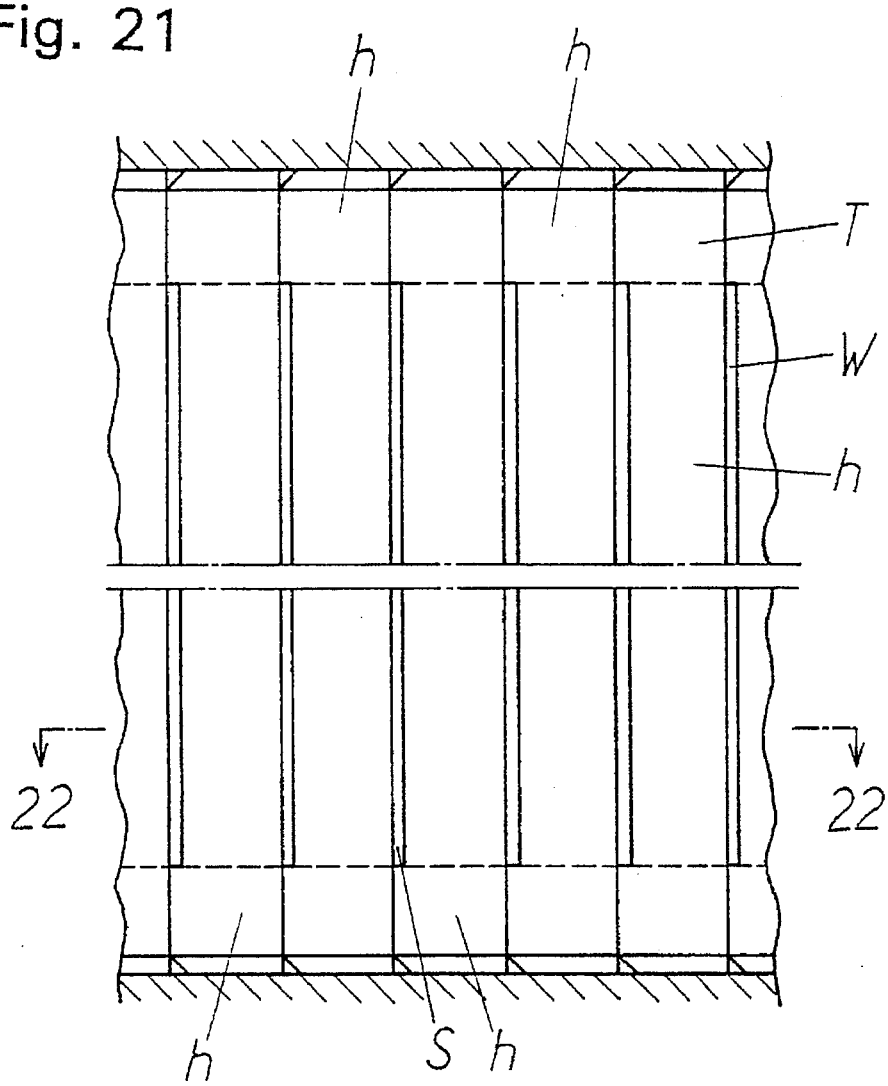
FIG. 21 is a schematic section view showing a state of the longitudinally extending members which are disposed in parallel, of an embodiment other than the embodiment shown in FIG. 13.
Figure 22:
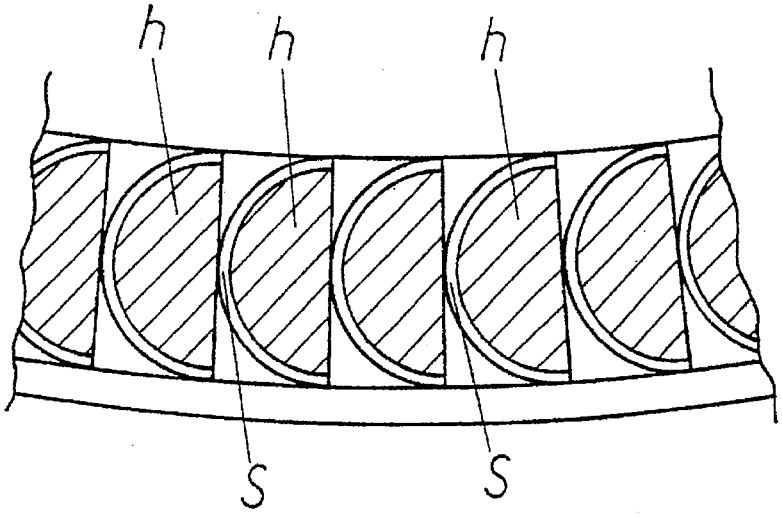
FIG. 22 is a schematic section view taken along line 22—22 in FIG. 21.
Figure 23:
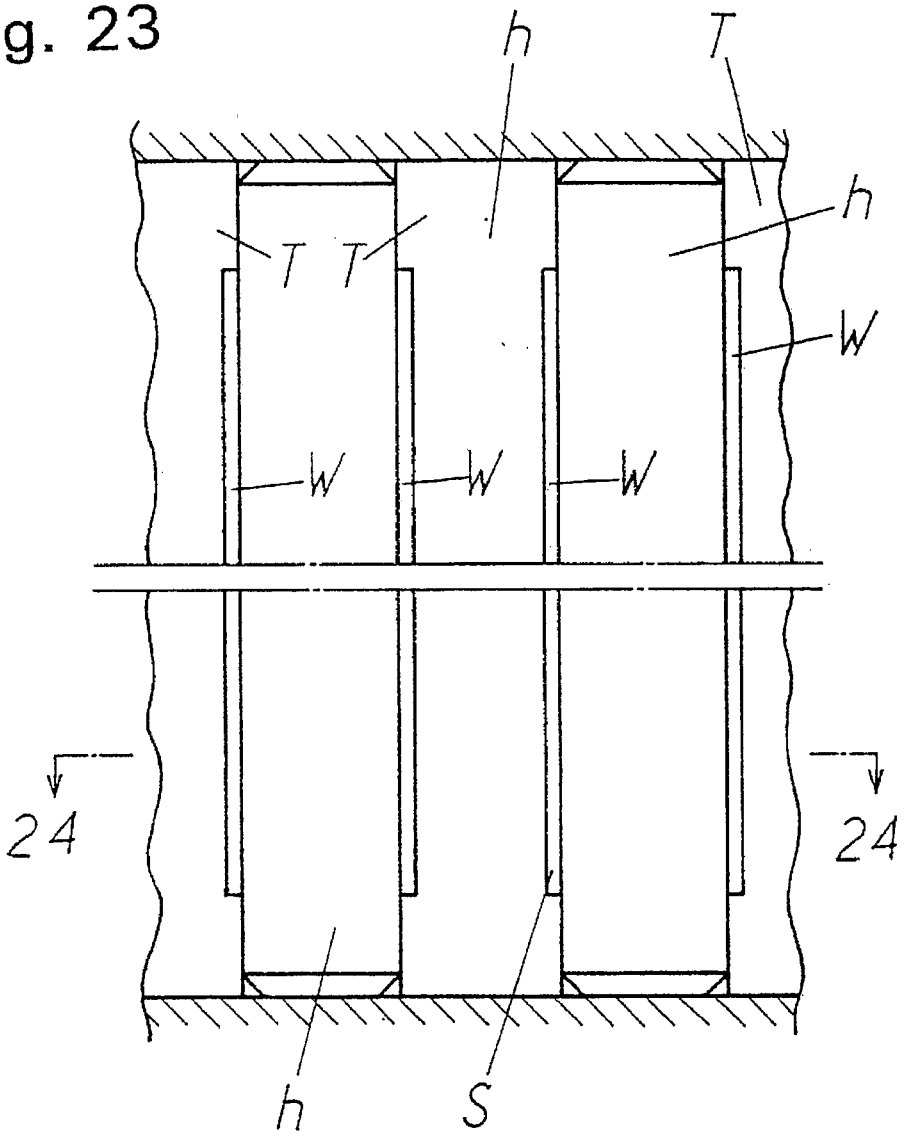
FIG. 23 is a schematic section view showing a state of the longitudinally extending members which are disposed in parallel, of an embodiment other than the embodiment shown in FIG. 13.
Figure 24:
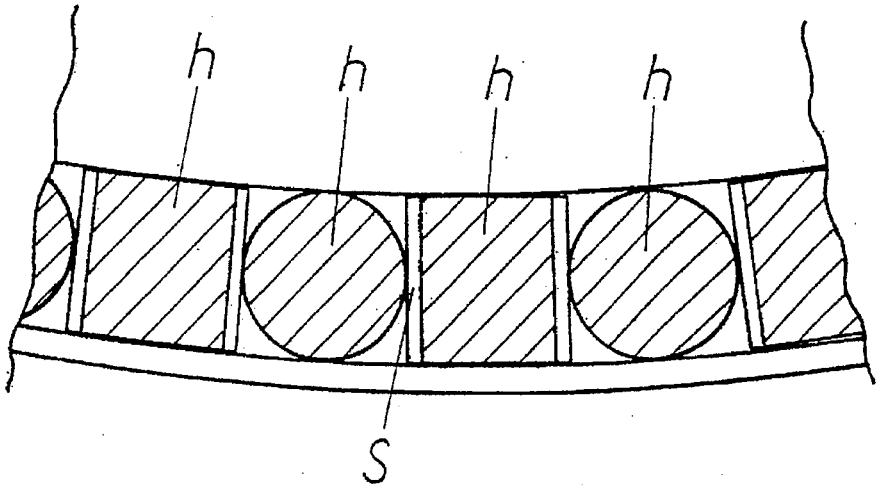
FIG. 24 is a schematic section view taken along line 24—24 in FIG. 23.
Figure 25:
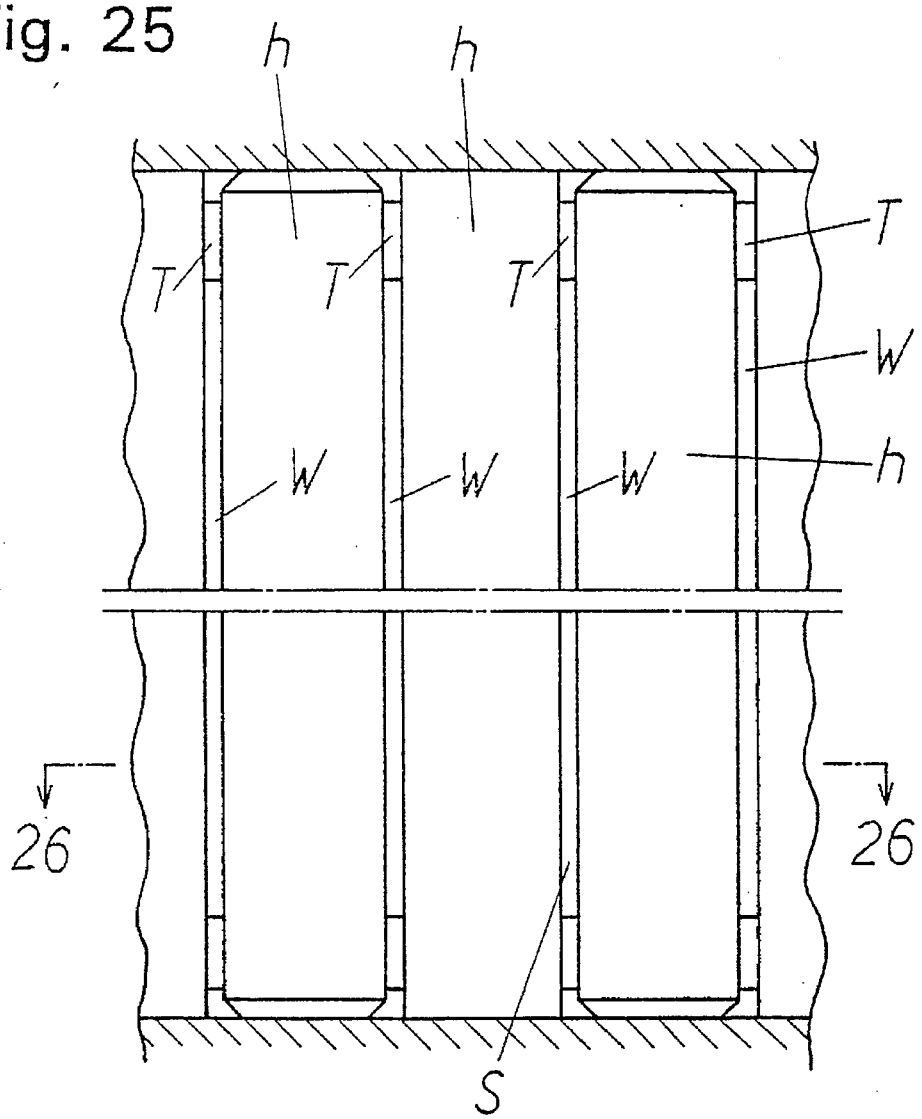
FIG. 25 is a schematic section view showing a state of the longitudinally extending members which are disposed in parallel, of an embodiment other than the embodiment shown in FIG. 13.
Figure 26:
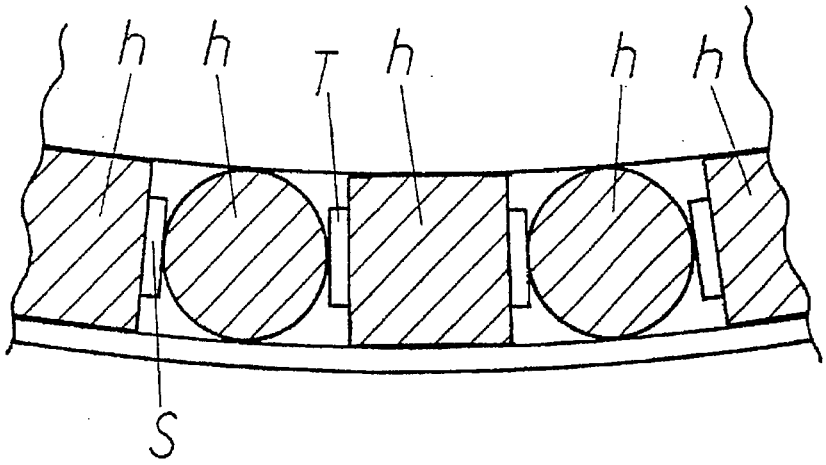
FIG. 26 is a schematic section view taken along line 26—26 in FIG. 25.
Figure 27:
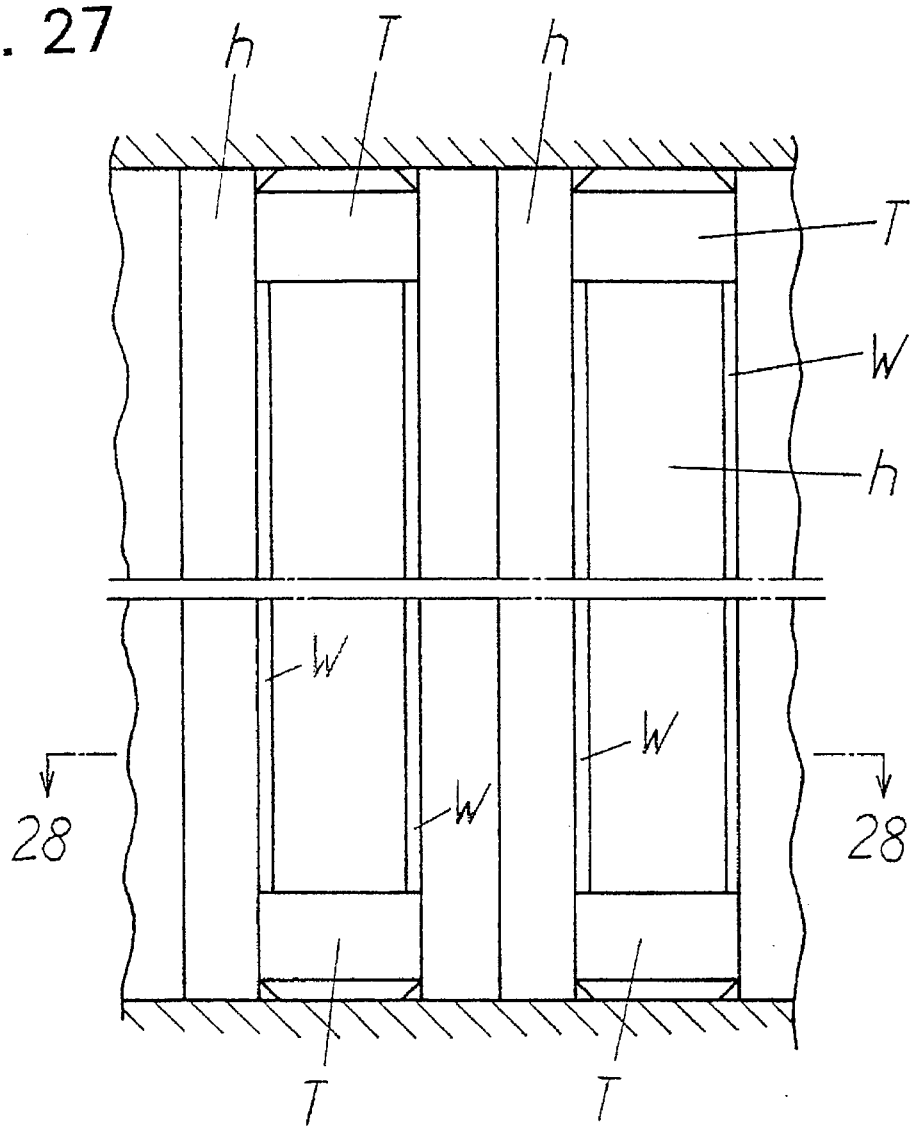
FIG. 27 is a schematic section view showing a state of the longitudinally extending members which are disposed in parallel, of an embodiment other than the embodiment shown in FIG. 13.
Figure 28:
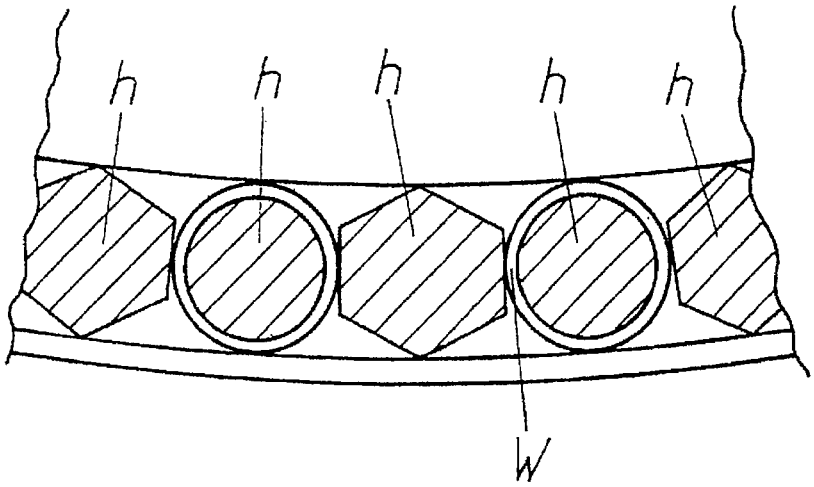
FIG. 28 is a schematic section view taken along a line 28—28 in FIG. 27.

The disadvantage is solved by, for example, as shown in FIGS. 19 and 20, that the section of the longitudinally extending member h is made semicircular, and the longitudinally extending members h may be sequentially arranged so that an arc portion of one of the adjacent longitudinally extending members faces a straight line portion of the other of the longitudinally extending members facing thereto. Also, as shown in FIGS. 21 and 22, a section of the longitudinally extending member h may be made semi-elliptical, and the longitudinally extending members h may be sequentially arranged so that an arc portion of one of the adjacent longitudinally extending members faces a straight line portion of the other of the longitudinally extending members situated adjacent thereto. Further, as shown in FIGS. 23 through 28, a section of one of the longitudinally extending members h is made circular and a section of the other thereof is made polygonal.

Incidentally, in FIGS. 19 through 28, T represents a projection, W represents a recess, and S represents a space formed between a longitudinally extending member h and a longitudinally extending member h.

In a papermaking screen of a first mode according to the present invention, a plurality of longitudinally extending members is arranged parallel in an annular shape so as to make a space therebetween, and each being engaged at one end with an annular recess formed on a first supporting member and engaged at the other end with an annular recess formed on an intermediate supporting member adjacent to the first supporting member, respectively, without fixing by welding. A plurality of longitudinally extending members is arranged parallel in an annular shape so as to make a space therebetween, and each being engaged at one end with an annular recess formed on a second supporting member and engaged at the other end with an annular recess formed on an intermediate supporting member adjacent to the second supporting member, respectively, without fixing by welding. A plurality of longitudinally extending members is arranged parallel in an annular shape so as to make a space therebetween, and each being engaged at one end with an annular recess formed on the intermediate supporting member and engaged at the other end with an annular recess formed on the intermediate supporting member adjacent to the intermediate supporting member, respectively, without fixing by welding. Also, each of a plurality of space holding members is fixed to the first supporting member at one end and fixed to the second supporting member at the other end to thereby hold or form a space between the first supporting member and the second supporting member. Since the number of the fixing portions is greatly reduced, the longitudinally extending members can be easily provided and production of the papermaking screen can be greatly improved.

Further, the papermaking screen may be structured such that n ($n \geqq 2$) pieces or groups of intermediate supporting members are provided between the first supporting member and the second supporting member. A first longitudinally extending member group is disposed between the first supporting member and an intermediate supporting member adjacent to the first supporting member; a second longitudinally extending member group is disposed between the second supporting member and an intermediate supporting member adjacent to the second supporting member; and (n−1) pieces or groups of the longitudinally extending member groups are disposed between the intermediate supporting member and the intermediate supporting member. Therefore, the longitudinally extending members are made shorter in length to thereby have rigidity, prevent deformation of the longitudinally extending members, keep the space between the longitudinally extending members uniform, and maintain performance of the papermaking screen.

Also, in a papermaking screen of a second mode according to the present invention, a plurality of longitudinally extending members is arranged parallel in an annular shape so as to make a space therebetween, each being engaged at one end with an annular recess formed on a first supporting member and engaged at the other end with an annular recess formed on an intermediate supporting member, respectively, without fixing by welding. A plurality of longitudinally extending members is arranged parallel in an annular shape so as to make a space therebetween, each being engaged at one end with an annular recess formed on a second supporting member and engaged at the other end with an annular recess formed on the intermediate supporting member, respectively, without fixing by welding. Each of a plurality of space holding members is fixed to the first engaging member at one end and fixed to the second engaging member at the other end to thereby hold or form a space between the first supporting member and the second supporting member. Thus, the number of the fixing portions is greatly reduced. Also, the longitudinally extending members can be easily provided, and production of the papermaking screen can be greatly improved.

Further, the papermaking screen is structured such that an intermediate supporting member is provided between the first supporting member and the second supporting member; a first longitudinally extending member group is disposed between the first supporting member and the intermediate supporting member; and a second longitudinally extending member group is disposed between the intermediate supporting member and the second supporting member. Therefore, the longitudinally extending members are made shorter in length to thereby have rigidity, deformation of the longitudinally extending members is prevented, a space between the longitudinally extending members is kept uniform, and good performance of the papermaking screen is maintained.

In a papermaking screen of a third mode according to the present invention, a plurality of longitudinally extending members is arranged parallel in an annular shape so as to make a space therebetween, each being engaged at one end with an annular recess formed on a first supporting member and engaged at the other end with an annular recess formed on a second supporting member, respectively, without fixing by welding. Each of a plurality of space holding members is fixed to the first supporting member at one end and fixed to the second supporting member at the other end to thereby hold or form a space between the first supporting member and the second supporting member. Therefore, the number of the fixing portions is greatly reduced, the longitudinally extending members are easily provided, and production of the papermaking screen can be greatly improved.

Also, a section of the longitudinally extending members h may be made semicircular, and the longitudinally extending members h may be sequentially arranged so that an arc portion of the semicircle of one of the adjacent longitudinally extending members h faces a straight line portion of the other thereof. A section of the longitudinally extending members h may be made semi-elliptical, and the longitudinally extending members h may be sequentially arranged so that an arc portion of the semi-ellipse of one of the adjacent longitudinally extending members h faces a straight line portion of the other thereof. Also, a section of one of the adjacent longitudinally extending members h may be made circular, and a section of the other thereof may be made polygonal. The longitudinally extending members h are sequentially arranged so that an arc portion of the circle of one of the adjacent longitudinally extending members faces a straight line portion of the polygon of the other thereof. Therefore, in the present invention, influences by uniform space S due to abrasion is not greatly affected, when compared with a case where both adjacent longitudinally extending members h have a circular section.

While the invention has been explained with reference to the specific embodiments of the invention, the explanation is illustrative and the invention is limited only by the appended claims.

What is claimed is:

1. A papermaking screen comprising:

a first annular supporting member having a first annular recess formed at one side, a second annular supporting member having a second annular recess at one side, said second annular recess having a size corresponding to that of the first annular recess and orienting toward the first annular recess, a plurality of space holding members fixed to the first and second annular supporting members to establish a predetermined distance therebetween, and a plurality of elongated members situated in the first and second annular recesses and arranged parallel to each other between the first and second annular supporting members, at least one of two elongated members situated adjacent to each other having space forming means thereon relative to the other of the two elongated members, said space forming means being at least one projection integrally formed with the elongated member so that when the elongated members are arranged parallel to and contacted to each other, said at least one projection contacts the elongated member situated adjacent thereto to thereby form a space between the elongated members situated adjacent to each other, each elongated member having a semicircular shape with a curved portion and a flat portion in a lateral cross section for a substantial length thereof, said elongated members being arranged such that the curved portion in each of the elongated members faces the flat portion of each of the elongated members situated adjacent thereto.

2. A papermaking screen according to claim 1, wherein the elongated member has two annular projections at longitudinal ends thereof, a portion between the annular projections forming the space.

3. A papermaking screen comprising:

a first annular supporting member having a first annular recess formed at one side, a second annular supporting member having a second annular recess at one side, said second annular recess having a size corresponding to that of the first annular recess and orienting toward the first annular recess, at least one intermediate supporting member situated between the first and second annular supporting members and having two annular recesses each on one side thereof, a plurality of space holding members fixed to the first and second annular supporting members to establish a predetermined distance therebetween, said space holding members passing through said at least one intermediate supporting member, and a plurality of elongated situated in the first and second annular recesses and arranged parallel to each other between the first and second annular supporting members, said plurality of elongated members being arranged annularly, being cut perpendicularly to longitudinal directions of the elongated members to divide said elongated members into at least two annular groups arranged side by side in the longitudinal directions and being formed of divided elongated members, each of said divided elongated members near the first annular supporting member being located in the first annular recess at one end and in the annular recess of the intermediate supporting member at the other end thereof, each of said divided elongated member near the second annular supporting member being located in the second annular recess at one end and in the annular recess of the intermediate supporting member at the other end thereof, said divided elongated members in each annular group being arranged parallel to each other with a space, at least one of two divided elongated members situated adjacent to each other in each annular group having space forming means thereon relative to the other of the two divided elongated members so that when the divided elongated members are arranged parallel to and contacted to each other, the space is formed between the divided elongated members situated adjacent to each other.

4. A papermaking screen according to claim 3, wherein the elongated members in each annular group are divided into first and second groups, each elongated member in the first group having two projections at longitudinal ends and each elongated member in the second group having no projection, said elongated members in each annular group being arranged annularly such that the elongated members in the first and second groups are alternately arranged, respectively.

5. A papermaking screen according to claim 3, wherein the elongated members in each annular group are divided into first and second groups, each elongated member in the first group having two projections at longitudinal ends and each elongated member in the second group having one projection in a middle thereof, said elongated members in each annular group being arranged annularly such that the elongated members in the first and second groups are alternately arranged, respectively.

6. A papermaking screen according to claim 3, wherein the elongated member in each annular group has a circular shape in a lateral cross section at a portion other than the space forming means.

7. A papermaking screen according to claim 3, wherein each of the elongated members has a semicircular shape with a curved portion and a flat portion in a lateral cross section for a substantial length thereof, said elongated members in each annular group being arranged such that the curved portion in each of the elongated members faces the flat portion of each of the elongated members situated adjacent thereto.

8. A papermaking screen according to claim 3, wherein the elongated members in each annular group are divided into first and second groups, each elongated member in the first group having a circular shape in a lateral cross section for a substantial length thereof and each elongated member in the second group having a shape other than circular in a lateral cross section for a substantial length thereof, said elongated members in each annular group being arranged annularly such that the elongated members in the first and second groups are alternately arranged, respectively.

9. A papermaking screen according to claim 3, wherein said plurality of elongated members situated between the first and second annular supporting members is divided into more than two in the longitudinal directions to form more than three annular groups, one intermediate supporting member being situated between the annular groups adjacent to each other.

10. A papermaking screen according to claim 9, wherein said space forming means in each annular group is at least one projection integrally formed with the divided elongated member in each group, said projection contacting the divided elongated member situated adjacent thereto to thereby form the space between the divided elongated members.

11. A papermaking screen comprising:

a first annular supporting member having a first annular recess formed at one side, a second annular supporting member having a second annular recess at one side, said second annular recess having a size corresponding to that of the first annular recess and orienting toward the first annular recess, a plurality of space holding members fixed to the first and second annular supporting members to establish a predetermined distance therebetween, and a plurality of elongated members situated in the first and second annular recesses and arranged parallel to each other between the first and second annular supporting members, at least one of two elongated members situated adjacent to each other having space forming means thereon relative to the other of the two elongated members, said space forming means being at least one projection integrally formed with the elongated member so that when the elongated members are arranged parallel to and contacted to each other, said at least one projection contacts the elongated member situated adjacent thereto to thereby form a space between the elongated members situated adjacent to each other, said elongated members being divided into first and second groups, each elongated member in the first group having a circular shape in a lateral cross section for a substantial length thereof and each elongated member in the second group having a shape other than circular in a lateral cross section for a substantial length thereof, said elongated members being arranged annularly in the first and second annular recesses such that the elongated members in the first and second groups are alternately arranged, respectively.

12. A papermaking screen according to claim 11, wherein the shape other than circular in the second group is a polygonal shape.

* * * * *